US010663879B2

(12) United States Patent
Kitajima

(10) Patent No.: US 10,663,879 B2
(45) Date of Patent: May 26, 2020

(54) IMAGE FORMING APPARATUS WITH PLURAL CORONA CHARGERS

(71) Applicant: CANON KABUSHIKI KAISHA, Tokyo (JP)

(72) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/269,577

(22) Filed: Feb. 7, 2019

(65) Prior Publication Data

US 2019/0187583 A1 Jun. 20, 2019

Related U.S. Application Data

(63) Continuation of application No. PCT/JP2017/029576, filed on Aug. 10, 2017.

(30) Foreign Application Priority Data

Aug. 10, 2016 (JP) ..... 2016-157778
Jun. 5, 2017 (JP) ..... 2017-111181

(51) Int. Cl.
*G03G 15/02* (2006.01)

(52) U.S. Cl.
CPC ..... *G03G 15/0291* (2013.01); *G03G 15/0266* (2013.01); *G03G 2215/026* (2013.01)

(58) Field of Classification Search
CPC ..... G03G 15/0291; G03G 15/0266; G03G 15/5037; G03G 2215/026; G03G 2215/027
See application file for complete search history.

(56) References Cited

U.S. PATENT DOCUMENTS 6,389,240 B2 5/2002 Toyohara et al.
6,963,708 B2 11/2005 Sekovski et al.
(Continued)

FOREIGN PATENT DOCUMENTS

JP 2000-066483 A 3/2000
JP 2005-084688 A 3/2005
(Continued)

OTHER PUBLICATIONS

International Search Report dated Nov. 7, 2017, in International Application No. PCT/JP2017/029576.

*Primary Examiner* — Sophia S Chen
(74) *Attorney, Agent, or Firm* — Venable LLP

(57) ABSTRACT

In an image forming apparatus, a charging process of a photosensitive member is performed by forming a combined surface potential Vd(U+L) by superimposing, on a first charge potential Vd(U) formed on a surface of the photosensitive member by a first corona charger, a second charge potential Vd(L) provided by a second corona charger. The apparatus includes a controller for executing an adjusting operation in which a superimposition start voltage Vg(L)A, which is the second voltage Vg(L) at which formation of the combined surface potential Vd(U+L) is started, is acquired by changing the second voltage Vg(L) applied to a grid electrode of the second corona charger in a state that the first charge potential Vd(U) is formed on the surface of the photosensitive member and in which setting of the second voltage Vg(L) during the charging process is adjusted on the basis of the superimposition start voltage Vg(L).

18 Claims, 11 Drawing Sheets

(56) References Cited

U.S. PATENT DOCUMENTS

| | | | | |
|---|---|---|---|---|
| 9,726,999 | B2 | 8/2017 | Kitajima | |
| 2007/0160389 | A1 | 7/2007 | Zona et al. | |
| 2013/0294787 | A1* | 11/2013 | Zaretsky | G03G 15/0291 399/50 |
| 2013/0294788 | A1 | 11/2013 | Zaretsky | |
| 2016/0161878 | A1 | 6/2016 | Kitajima | |
| 2018/0046122 | A1 | 2/2018 | Kitajima | |
| 2018/0143561 | A1 | 5/2018 | Kitajima | |
| 2018/0143574 | A1 | 5/2018 | Kitajima | |
| 2018/0149994 | A1* | 5/2018 | Ogawara | G03G 15/0266 |

FOREIGN PATENT DOCUMENTS

| | | | |
|---|---|---|---|
| JP | 2007-114510 | A | 5/2007 |
| JP | 5382409 | B2 | 1/2014 |
| JP | 2016-109793 | A | 6/2016 |

* cited by examiner

IMAGE FORMING APPARATUS WITH PLURAL CORONA CHARGERS

TECHNICAL FIELD

The present invention relates to an image forming apparatus, of an electrophotographic type, such as a copying machine, a printer or a facsimile machine.

BACKGROUND ART

In the image forming apparatus of the electrophotographic type, as a charging means for electrically charging a photosensitive member (electrophotographic photosensitive member), a corona charger (hereinafter, also referred simply to as a "charger") has been widely used. In Japanese Laid-Open Patent Application JP-A 2005-84688 and Japanese Patent No. 5382409, in a constitution using the corona charger, in order to meet speed-up of image formation or the like, a technique using a plurality of corona chargers and a plurality of grid electrodes has been proposed.

However, even when a plurality of corona chargers are used, in the case where a charging process of the photosensitive member having large electrostatic capacity is performed or in the like case, "charging non-uniformity" such that a charge potential of the photosensitive member becomes non-uniformity occurs in some instances. As a result, image defects such as image density non-uniformity and "roughness" due to a fluctuation in image dot occur in some instances.

On the other hand, in JP-A 2005-84688, a decrease in potential non-uniformity by using grid electrodes different in aperture ratio between an upstream side and a downstream side with respect to a rotational direction of the photosensitive member has been proposed.

Further, in Japanese Patent No. 5382409, a method in which two discharging wires are provided and voltages applied to the two discharging wires, a grid electrode and a shield electrode, respectively, are independently controlled has been proposed. However, in the conventional methods, it turned out that in a constitution in which a charging process of the photosensitive member is carried out by forming a combined surface potential by superimposing charge potentials formed by a plurality of chargers, it is difficult to sufficiently reduce the "charging non-uniformity".

That is, in a constitution in which a combined surface potential is formed by superimposing a charge potential formed by a second charger on a charge potential formed by a first charger, a relationship between the charge potentials formed by the respective chargers is important to make a finally formed charge potential of the photosensitive member uniform. In the case where a photosensitive member having large electrostatic capacity and large dark decay is used or in the like case, the relationship between the charge potentials by the first and second chargers is deviated from a predetermined range and the charge potential of the photosensitive member cannot be made uniform in some instances. Particularly, when the charge potential formed by the first charger exceeds a value of a voltage applied to the grid electrode of the second charger, it becomes difficult to control the charge potential of the photosensitive member by the second charger, so that the "charging non-uniformity" increases.

When a relationship between the aperture ratios of the upstream side grid and the downstream side grid is only defined as described in JP-A 2005-84688, it is insufficient as a counter measure against the above-described problem. Further, the constitution of Japanese Patent No. 5382409 is a constitution such that a single common grid electrode is provided for the two discharging wires, and therefore, a relationship between the charge potential formed on the upstream side and the charge potential formed on the downstream side cannot be properly controlled, so that the reduction in "potential non-uniformity" becomes insufficient.

SUMMARY OF THE INVENTION

The above object is accomplished by an image forming apparatus according to the present invention. In summary, the present invention is an image forming apparatus comprising: a photosensitive member; first and second corona chargers for performing a charging process of the photosensitive member; and voltage applying means for applying a first voltage Vg(U) and a second voltage Vg(L) which are independently controllable, to grid electrodes of the first and second corona chargers, respectively; wherein the charging process is performed by forming a combined surface potential Vd(U+L) by superimposing, on a first charge potential Vd(U) formed on a surface of the photosensitive member by the first corona charger, a second charge potential Vd(L) provided by the second corona charger, wherein the image forming apparatus comprises control means for executing an adjusting operation in which a superimposition start voltage Vg(L)A which is the second voltage Vg(L) at which formation of the combined surface potential Vd(U+L) is started is acquired by changing the second voltage Vg(L) in a state that the first charge potential Vd(U) is formed on the surface of the photosensitive member and in which setting of the second voltage Vg(L) during the charging process is adjusted on the basis of the superimposition start voltage Vg(L).

According to another embodiment of the present invention, there is provided an image forming apparatus comprising: a photosensitive member; first and second corona chargers for performing a charging process of the photosensitive member; and first voltage applying means for applying a first voltage Vg(U) to a grid electrode of the first corona charger; second voltage applying means for applying a second voltage Vg(L) to a grid electrodes of the first and second corona chargers; potential detecting means for detecting a combined surface potential Vd(U+L) acquired by superimposing, on a first charge potential Vd(U) formed on a surface of the photosensitive member by the first corona charger, a second charge potential Vd(L) provided by the second corona charger; and an executing portion for executing, in a period other than an image forming period, an adjusting operation including a first adjusting operation in which the combined surface potential Vd(U+L) is controlled in a target potential range by adjusting the second voltage Vg(L) while electrically charging the surface of the photosensitive member by the first and second corona chargers and including a second adjusting operation in which non-uniformity of the combined surface potential Vd(U+L) with respect to a circumferential direction of the photosensitive member is controlled in a predetermined range by adjusting the first voltage Vg(U) while electrically charging the surface of the photosensitive member by the first and second corona chargers.

EMBODIMENTS FOR CARRYING OUT THE INVENTION

In the following, an image forming apparatus according to the present invention will be described specifically with reference to the drawings.

Embodiment 1

<1. Image Forming Apparatus>

<1-1. General Structure and Operation of Image Forming Apparatus>

Figure 1:
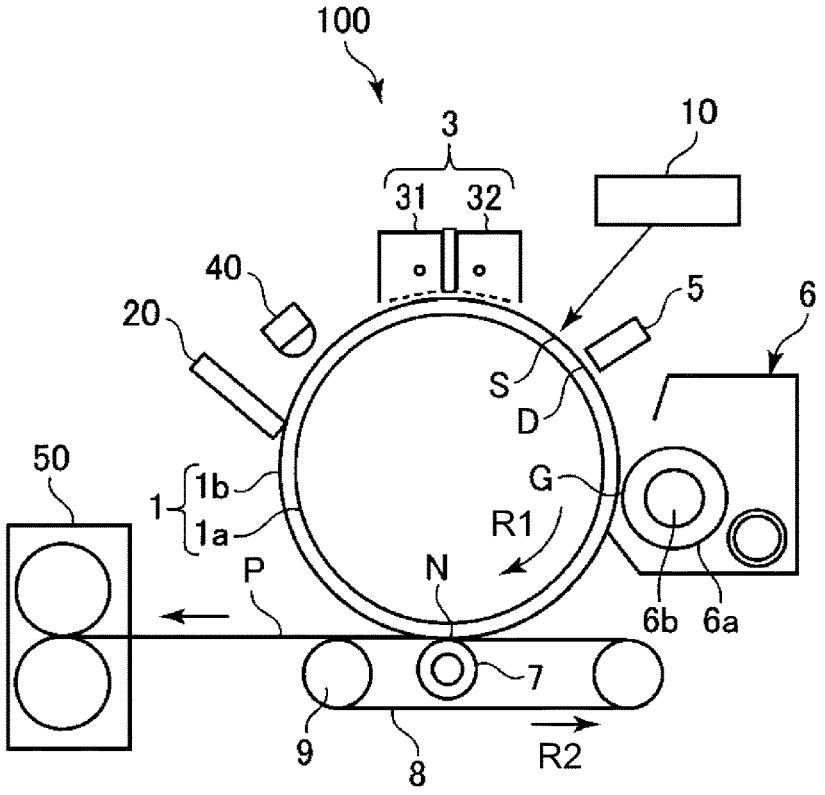
FIG. 1 is a schematic sectional view of an image forming apparatus.

FIG. 1 is a schematic sectional view of an image forming apparatus 100 in this embodiment. The image forming apparatus 100 includes the photosensitive member 1 as an image bearing member. The photosensitive member 1 is rotationally driven in an arrow R1 direction (clockwise direction) in FIG. 1 at a predetermined peripheral speed (process speed). The surface of the rotating photosensitive member 1 is electrically charged to a predetermined polarity (negative in this embodiment) and a predetermined potential by a charging device 3 as a charging means. That is, the charging device 3 forms a charge potential (non-exposed portion potential) on the surface of the photosensitive member 1. The surface of the charged photosensitive member 1 is subjected to scanning exposure to light by a display device 10 as an exposure means depending on image information, and an electrostatic image (electrostatic latent image) is formed on the photosensitive member 1. In this embodiment, a wavelength of the light emitted from the exposure device 10 is 675 nm, and an exposure amount on the surface of the photosensitive member 1 by the exposure device 10 is variable in a range of 0.1-0.5 μJ/cm2. The exposure device 10 adjusts the exposure amount depending on a developing condition, so that a predetermined exposed portion potential can be formed on the surface of the photosensitive member 1.

The electrostatic image formed on the surface of the photosensitive member 1 is developed (visualized) with toner as a developer by a developing device 6 as a developing means, so that a toner image is formed on the photosensitive member 1. In this embodiment, the photosensitive member surface is exposed to light after being charged, and thus an absolute value of the charge potential of the photosensitive member 1 lowers at an exposed portion of the photosensitive member 1, so that on the exposed portion, the toner is charged to the same polarity as the charge polarity (negative in this embodiment) of the photosensitive member 1 (reverse development). In this embodiment, the developing device 6 is a developing device of a two-component magnetic brush type. The developing device 6 includes a hollow cylindrical developing sleeve 6*a* as a developer carrying member. The developing sleeve 6*a* is rotationally driven by a driving motor (not shown) as a driving means. Inside the developing sleeve 6*a*, i.e., at a hollow portion of the developing sleeve 6*a*, a magnet roller 6*b* as a magnetic field generating means is provided. The developing sleeve 6*a* carries a two-component developer containing toner (non-magnetic toner particles) and a carrier (magnetic carrier particles) by a magnetic force generated by the magnet roller 6*b*. Then, the detecting sleeve 6*a* feeds the developer to an opposing portion (developing position) G to the photosensitive member 1 by being rotationally driven. During a developing operation, to the developing sleeve 6*a*, from the developing voltage source (high voltage source circuit) S5 (FIG. 4), a predetermined developing voltage (developing bias) is applied.

Incidentally, the image forming apparatus 100 includes a potential sensor 5 as a potential detecting means for detecting the surface potential of the photosensitive member 1. The potential sensor 5 is provided so as to be capable of detecting the surface potential of the photosensitive member 1 at a detecting position (sensor position) D between an exposure position S on the photosensitive member 1 by the exposure device 10 and a developing position G by the developing device 6. Control using the potential sensor 5 will be described later.

Figure 4:
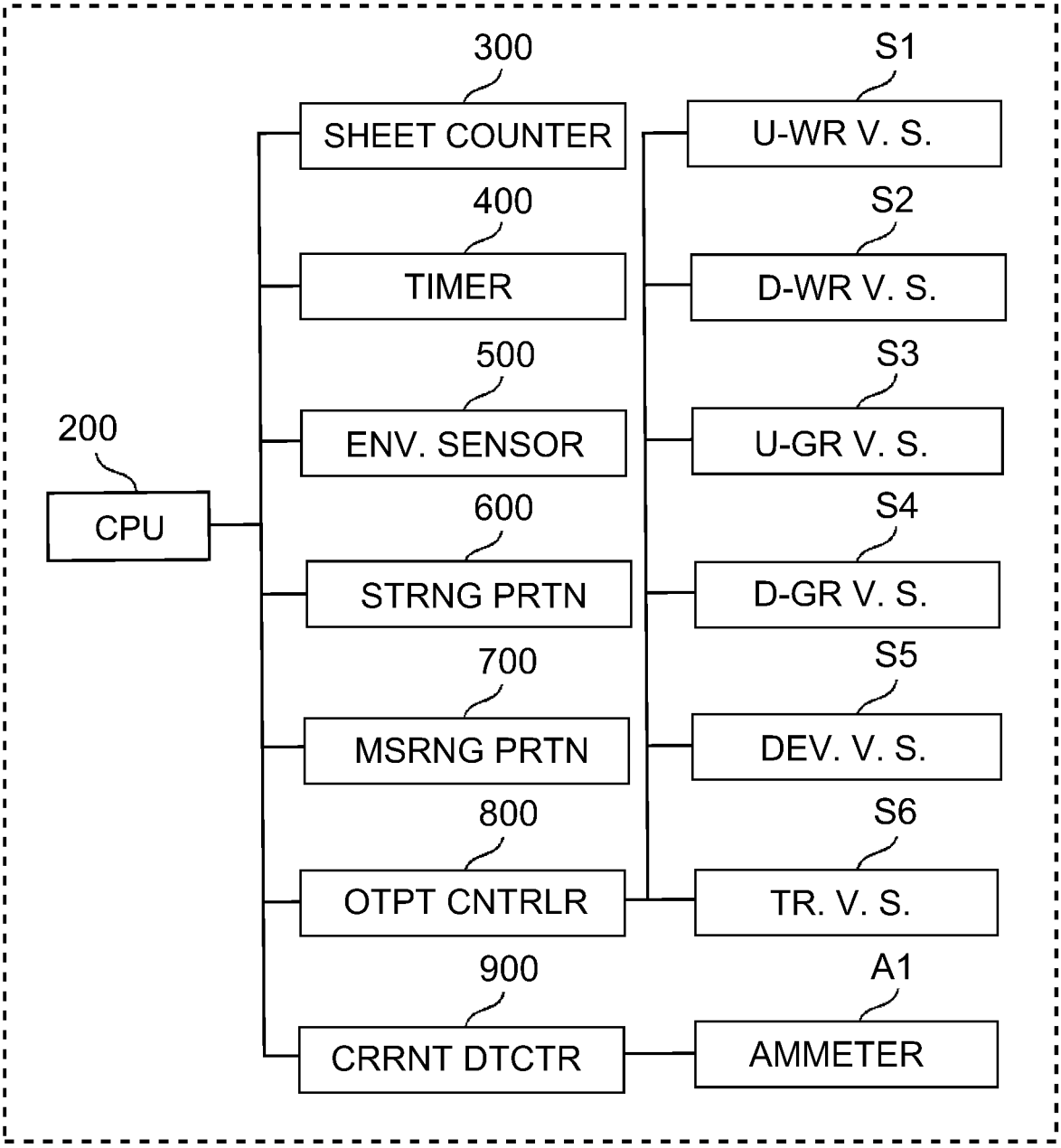
FIG. 4 is a block diagram showing a control mode of a principal part of the image forming apparatus.

A transfer belt 8 as a recording material carrying member is provided so as to oppose the photosensitive member 1. The transfer belt 8 is wound and stretched by a plurality of stretching rollers (supporting rollers), and of these stretching rollers, a driving force is transmitted by a driving roller 9, so that the transfer belt 8 is rotated (circulated and moved) in an arrow R2 direction in FIG. 1 at a peripheral speed which is the same as the peripheral speed of the photosensitive member 1. In an inner peripheral surface side of the transfer belt 8, at a position opposing the photosensitive member 1, a transfer roller 7 which is a roller-type transfer member as a transfer means is provided. The transfer roller 7 is pressed against the transfer belt 8 toward the photosensitive member 1 and thus forms a transfer portion N where the photosensitive member 1 and the transfer belt 7 are in contact with each other. As described above, the toner image formed on the photosensitive member 1 is transferred, at the transfer portion N, onto a recording material P such as paper fed and carried by the transfer belt 8. During a transfer step, to the transfer roller 7, a transfer voltage (transfer bias) of an opposite polarity (positive in this embodiment) to a charge polarity of the toner during the development is applied from a transfer voltage source (high voltage source circuit) S6 (FIG. 4).

The recording material P on which the toner image is transferred is fed to a fixing device 50 as a fixing means and is heated and pressed by the fixing device 50, so that the toner image is fixed (melt-fixed) on the surface of the recording material P, and thereafter, the recording material P is discharged (outputted) to an outside of an apparatus main assembly of the image forming apparatus 100.

On the other hand, the toner (transfer residual toner) remaining on the photosensitive member 1 after the transfer step is removed and collected from the surface of the photosensitive member 1 by a cleaning device 20 as a cleaning means. The surface of the photosensitive member 1 after being cleaned by the cleaning device 20 is irradiated with light (discharging light) by a light (optical)-discharging device 40 as a discharging means, so that at least a part of residual electric charges is removed. In this embodiment, the light-discharging device 40 includes an LED chip array as a light source. In this embodiment, a wavelength of the light emitted from the light-discharging device 40 is 635 nm, and an exposure amount of the surface of the photosensitive member 1 by the light-discharging device 40 is variable in a range of 1.0-7.0 $\mu mJ/cm^2$. In this embodiment, an initial value of the exposure amount by the light-discharging device 40 is set at 4.0 $\mu J/cm^2$.

Operations of the respective portions of the image forming apparatus 100 are subjected to integrated control by a CPU 200 as a control means provided in the apparatus main assembly of the image forming apparatus 100.

<1-2. Photosensitive Member>

In this embodiment, the photosensitive member 1 is a cylindrical electrophotographic photosensitive member (photosensitive drum) including an electroconductive substrate 1*a* formed of aluminum or the like and a photoconductive layer (photosensitive layer) 1*b* formed on an outer peripheral surface of the substrate 1*a*. The photosensitive member 1 is rotationally driven by a driving motor (not shown) as a driving means. In this embodiment, the charge polarity of the photosensitive member 1 is negative. In this embodiment, the photosensitive member 1 is an amorphous silicon photosensitive member of 84 mm in outer diameter, and the photosensitive layer is 40 μm in thickness and 10 in dielectric constant.

The photosensitive member 1 is not limited to that in this embodiment, but for example, may also be an OPC (organic photoconductor). Further, the charge polarity thereof may also be different from that in this embodiment.

<1-3. Charging Device>

Figure 2:
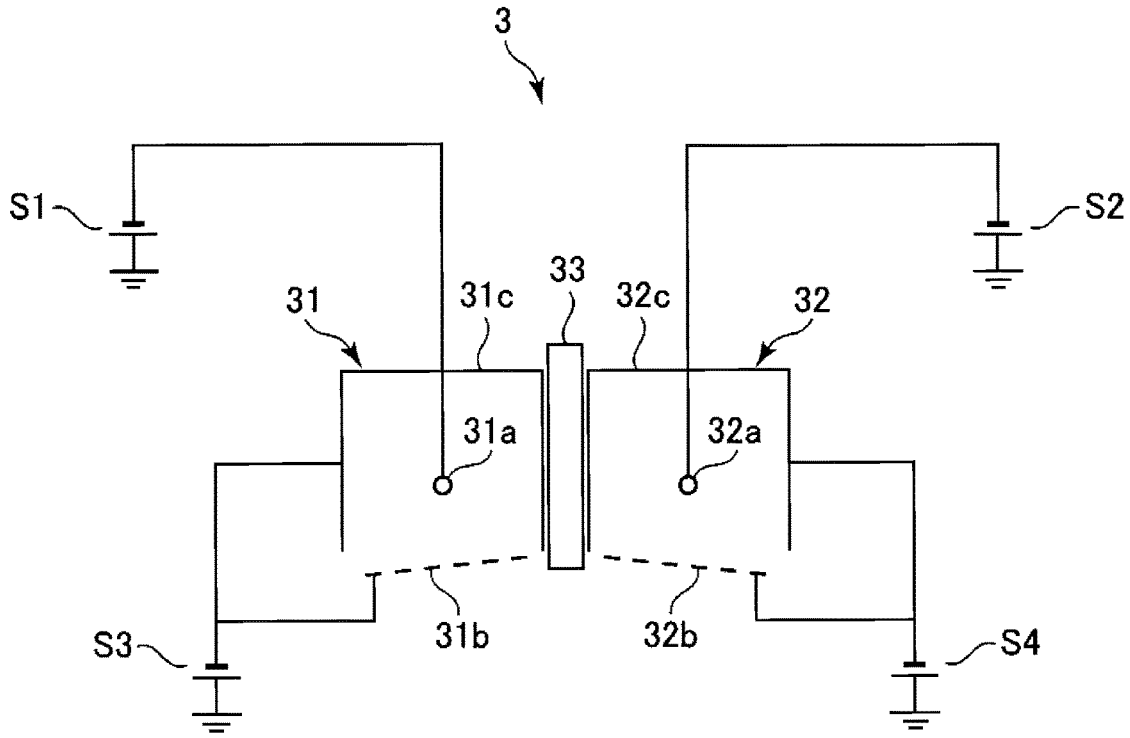
FIG. 2 is a schematic sectional view of a charging device.
Figure 3:
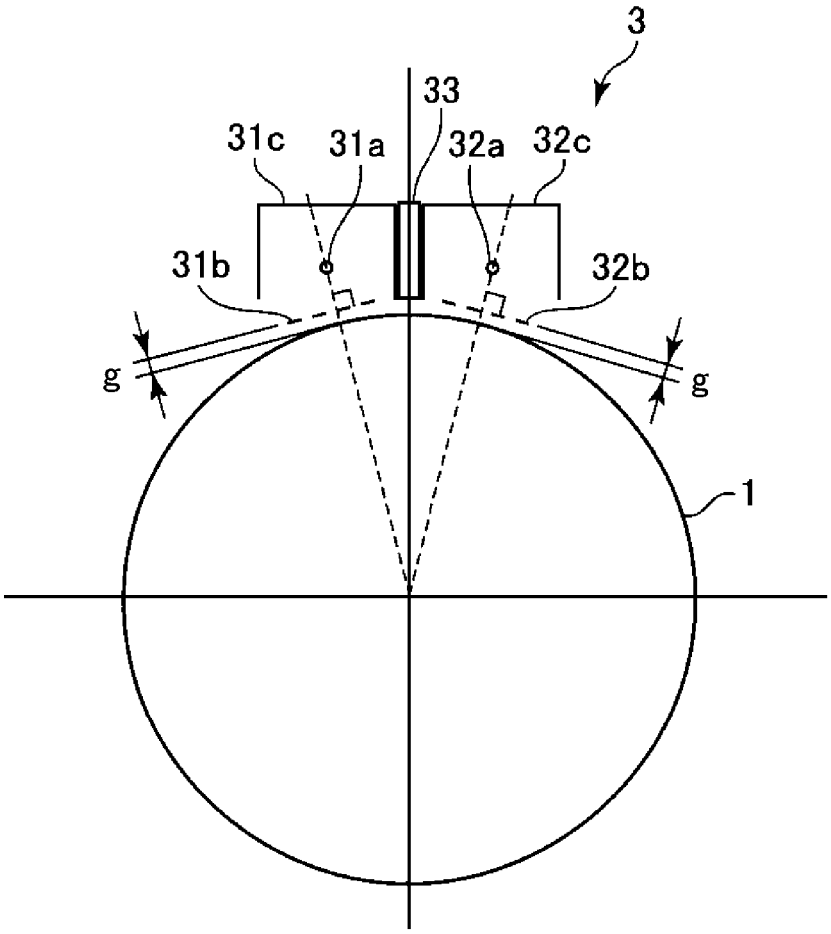
FIG. 3 is a schematic sectional view showing an arrangement of grid electrodes of a corona charger.

FIGS. 2 and 3 are schematic sectional views of the charging device 3 in this embodiment. In this embodiment, the charging device 3 is disposed above the photosensitive member 1.

The charging device 3 includes, as a plurality of corona chargers, an upstream(−side) charger (first charger) 31 provided in an upstream side with respect to a surface movement direction of the photosensitive member 1 and a downstream(−side) charger (second charger) 32 provided in a downstream side with respect to the surface movement direction. The upstream charger 31 and the downstream charger 32 are disposed adjacent to each other along the surface movement direction of the photosensitive member 1. The upstream charger 31 and the downstream charger 32 are scorotron chargers and are constituted so that charge voltages (charging biases, high charge voltages) applied thereto are independently controlled. In the following, elements relating to the upstream charger 31 and the downstream charger 32 are distinguished from each other by adding prefixes "upstream" and "downstream" in some instances.

The upstream charger 31 and the downstream charger 32 include wire electrodes (discharging wires, discharging wires) 31*a* and 32*a* as discharging electrodes, grid electrodes 31*b* and 32*b* as control electrodes, and shield electrodes 31*c* and 32*c* as shielding members (casings), respectively. Further, between the upstream charger 31 and the downstream charger 32, an insulating plate 33, which is an insulating member formed of an electrically insulating material, is provided. As a result, when different voltages are applied to the upstream shield electrode 31*c* and the downstream shield electrode 32*c*, generation of leakage between the upstream shield electrode 31*c* and the downstream shield electrode 32*c* is prevented. The insulating plate 33 is constituted by a plate-like member and is about 2 mm in thickness with respect to an adjacent direction (surface movement direction of the photosensitive member 1) between the upstream shield electrode 31*c* and the downstream shield electrode 32*c*.

A width of the charging device 3 with respect to the surface movement direction of the photosensitive member 1 is 44 mm, and a width of a discharging region (region where discharge for permitting charge of the photosensitive member 1 can be generated) of the charging device 3 with respect to a direction substantially perpendicular to the surface movement direction of the photosensitive member 1 is 340 mm. A width of the discharging region of each of the upstream charger 31 and the downstream charger 32 with respect to the surface movement direction of the photosensitive member 1 is 20 mm, i.e., the same.

Each of the upstream wire electrode 31*a* and the downstream wire electrode 32*a* is a wire electrode constituted by an oxidized tungsten wire. As a material of the wire electrode, a material which is 60 μm in line diameter (diameter) and which is ordinarily used in the image forming apparatus of the electrophotographic type was employed. Each of the upstream wire electrode 31*a* and the downstream wire electrode 32*a* is disposed so that an axial direction thereof is substantially parallel to a rotational axis direction of the photosensitive member 1.

Each of the upstream grid electrode 31*b* and the downstream grid electrode 32*b* is a substantially flat plate-like grid electrode which is provided with a mesh-shaped opening formed by etching and which has a substantially rectangular shape elongated in one direction. As a material of the grid electrode, a material which is prepared by forming an anti-corrosion layer such as a nickel-plated layer on SUS (stainless steel) and which is ordinarily used in the image forming apparatus of the electrophotographic type was employed. Each of the upstream grid electrode 31*b* and the downstream grid electrode 32*b* is disposed so that a longitudinal direction thereof is substantially parallel to the rotational axis direction of the photosensitive member 1. Further, as shown in FIG. 3, each of the upstream grid electrode 31*b* and the downstream grid electrode 32*b* is disposed by changing an arrangement angle (inclination angle) so that a planar direction thereof extends along curvature of the photosensitive member 1. The arrangement angle of each of the upstream grid electrode 31*b* and the downstream grid electrode 32*b* is substantially perpendicular to a rectilinear line connecting the associated one of the upstream grid electrode 31*b* and the downstream grid electrode 32*b* with a rotation center of the photosensitive member 1. Further, each of closest distances (gaps) g between the photosensitive member 1 and the upstream grid electrode 31*b* and between the photosensitive member 1 and the downstream grid electrode 32*b* (hereinafter, referred to as "grid gaps") GAP(U) and GAP(L), respectively, is set in a range of 1.3±0.2 mm. Further, the aperture ratios of the upstream grid electrode 31*b* and the downstream grid electrode 32*b* are set at 90% and 80%, respectively. Values of the aperture ratios are not limited to those in this embodiment, but may also be appropriately changed depending on, for example, a kind, a rotational speed, a charging condition, and the like of the photosensitive member 1.

Each of the upstream shield electrode 31*c* and the downstream shield electrode 32*c* is a substantially box-like member formed of an electroconductive material and is provided with an opening at a position opposing the photosensitive member 1. The upstream grid electrode 31*b* and the downstream grid electrode 32*b* are disposed at the openings of the upstream shield electrode 31*c* and the downstream shield electrode 32*c*, respectively.

<1-4. Charge Voltage>

As shown in FIG. 2, the upstream wire electrode 31*a* and the downstream wire electrode 32*a* are connected with an upstream wire voltage source S1 and a downstream wire voltage source S2, respectively, which are DC voltage sources (high voltage source circuits). As a result, voltages applied to the upstream wire electrode 31*a* and the downstream wire electrode 32*a* can be independently controlled. Further, the upstream grid electrode 31*b* and the downstream grid electrode 32*b* are connected with an upstream grid voltage source S3 and a downstream grid voltage source S4, respectively, which are DC voltage sources (high voltage source circuits). As a result, voltages applied to the upstream grid electrode 31*b* and the downstream grid electrode 32*b* can be independently controlled. In the following, the upstream wire voltage source S1, the downstream wire voltage source S2, the upstream grid voltage source S3 and the downstream grid voltage source S4 are collectively referred to as "charging voltage sources" in some cases. The upstream grid voltage source S3 and the downstream grid voltage source S4 are examples of voltage applying means for applying voltages which can be independently controlled, to the grid electrodes 31*b* and 32*b* of the upstream charger 31 and the downstream charger 32, respectively.

Further, the upstream shield electrode 31*c* and the downstream shield electrode 32*c* are connected with the upstream grid voltage source S3 and the downstream grid voltage source S4, respectively, and thus have the same potentials as those of the upstream grid electrode 31*b* and the downstream grid electrode 32*b*, respectively.

Incidentally, the upstream and downstream shield electrodes 31*c* and 32*c* are not limited to those having the same potentials as those of the upstream and downstream grid electrode 31*b* and 32*b*, respectively, but may also be electrically grounded by being connected with grounding electrodes of the apparatus main assembly of the image forming apparatus 100. A constitution capable of independently controlling voltages applied to the wire electrodes 31*a* and 32*a* and the grid electrodes 31*b* and 32*b* of the upstream charger 31 and the downstream charger 32, respectively, may only be required to be employed.

FIG. 4 is a block diagram showing a schematic control mode of a principal part of the image forming apparatus 100. To the CPU 200, a sheet number counter 300, a timer 400, an environment sensor 500, a surface potential measuring portion 700, a high voltage output controller 800, a storing portion 600 and the like are connected. The sheet number counter 300 counts the number of sheets subjected to image formation (the number of printed sheets) every formation of the image on the recording material P. The timer 400 measures a time. The environment sensor 500 measures at least one of a temperature and a humidity of at least one of an inside and an outside of the apparatus main assembly of the image forming apparatus 100. The surface potential measuring portion 700 is a control circuit for controlling an operation of the potential sensor 5 under control of the CPU 200. The high voltage output controller 800 is a control circuit for controlling operations of the charge voltage sources S1-S4 and a developing voltage source S5 and a transfer voltage source S6 under control of the CPU 200. The storing portion 600 is a memory which is a storing means for storing programs and detection result of various detecting means, and stores, e.g., control data of the charge voltage and a measurement result of the surface potential of the photosensitive member 1. The CPU 200 carries out processes on the basis of the measurement result of the environment sensor 500 and information stored in the storing portion 600, and provides an instruction to the high voltage output controller 800, and thus controls the charge voltage sources S1-S4.

DC voltages applied to the upstream wire electrode 31*a* and the downstream wire electrode 32*a* (hereinafter, referred to as "wire voltages") are subjected to constant-current control so that values of currents flowing through the upstream wire electrode 31*a* and the downstream wire electrode 32*a* (hereinafter, referred to as "wire currents") are substantially constant at target current values. In this embodiment, the target current value of the wire current (primary current) is changeable in a range of −2000 to 0 μA. Further, DC voltages applied to the upstream grid electrode 31*b* and the downstream grid electrode 32*b* (hereinafter, referred to as "grid voltages" are subjected to constant voltage control so that values of voltages (hereinafter, referred to as "grid voltages") are substantially constant at target voltage values. In this embodiment, the target voltage value of the grid voltage is changeable in a range of −1300 to 0 V.

Incidentally, in FIG. 4, for convenience, an amount A1 and a current detecting portion 900 are also shown, but these members may be omitted.

<2. Control of Charge Potential>

In this embodiment, the photosensitive member 1 is electrically charged by forming a combined surface potential by superposing charge potentials formed by independently controlling charge voltages applied to the upstream charger 31 and the downstream charger 32. In the following, the charging process by the charging device 3 will be further described.

As regards symbols or numerals showing the potentials, the voltages, the currents, and the like, the symbols are distinguished from each other by adding "U" to the symbols relating to the upstream charger 31 and "L" to the symbols relating to the downstream charger 32, respectively, in some cases. Further, as regards the symbols showing the potentials, the potentials are distinguished from each other by adding "sens" to the symbols relating to a sensor position D and "dev" to the symbols relating to the developing position G, respectively, with respect to the rotational direction of the photosensitive member 1 in some cases.

<2 1. Charge Potential by Upstream Charger>

First, a first charge potential (hereinafter, also referred to as an "upstream charge potential") Vd(U) which is the charge potential formed on the surface of the photosensitive member 1 by the upstream charger 31 will be described.

The upstream charge potential Vd(U) is controlled in the following manner. In a state in which an upstream wire voltage is applied to the upstream wire electrode 31*a* by the upstream wire voltage source S1 and thus a predetermined upstream wire current Ip(U) is supplied, an upstream grid voltage Vg(U) is applied to the upstream grid electrode 31*b* by the upstream grid voltage source S3.

Figure 5:
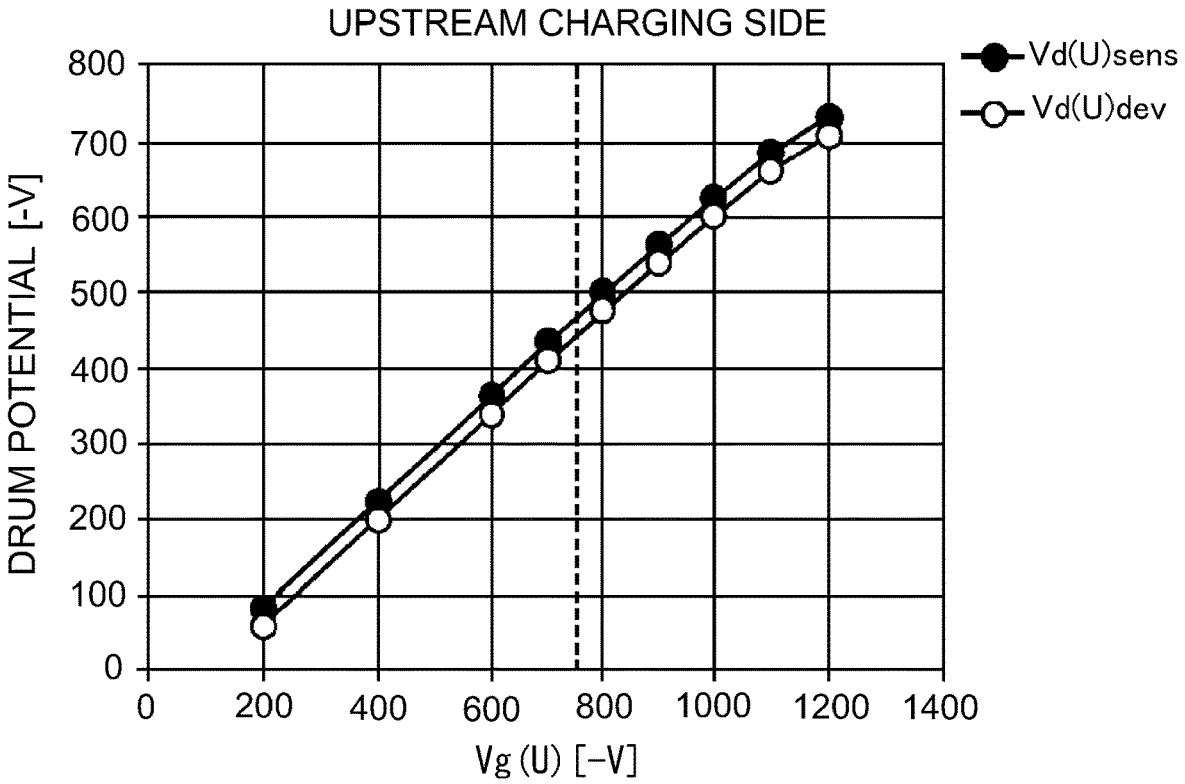
FIG. 5 is a graph showing a relationship between a charging voltage of an upstream charger and a charge potential of a photosensitive member.

FIG. 5 shows a relationship of the upstream grid voltage Vg(U) with upstream charge potentials Vd(U)sens and Vd(U)dev at the sensor position D and the developing position G, respectively, in the case where the peripheral speed of the photosensitive member 1 is 700 mm/sec. As shown in FIG. 5, the upstream charge potentials Vd(U) vary depending on the upstream grid voltage Vg(U). For example, in the case where the upstream wire current Ip(U) is −1600 μA, when the upstream grid voltage Vg(U) is −750 V, the upstream charge potential Vd(U)sens at the sensor position D is −480 V, and the upstream charge potential Vd(U)dev at the developing position G is −450 N. As regards the upstream grid voltage Vg(U), in order that the upstream charge potential Vd(U)dev at the developing position G is a target potential, the upstream charge potential Vd(U)sens at the sensor position D is controlled in consideration of a dark decay amount of the photosensitive member 1. In this embodiment, the upstream grid voltage Vd(U) is controlled so that the upstream charge potential Vd(U)dev at the developing position G falls within ±10 V of the target potential when the photosensitive member 1 is charged by the upstream charger 31 alone.

Incidentally, the target potential of the upstream charge potential Vd(U) can be arbitrarily set depending on a kind of the photosensitive member 1, a constitution of the image forming apparatus 100 and the like.

<2-2. Charge Potential by Downstream Charger>

Next, a second charge potential (hereinafter, also referred to as a "downstream charge potential") Vd(L), which is the charge potential formed on the surface of the photosensitive member 1 by the downstream charger 32, will be described.

The downstream charge potential Vd(L) is controlled in the following manner. In a state in which a downstream wire voltage is applied to the downstream wire electrode 32*a* by the downstream wire voltage source S2 and thus a predetermined downstream wire current Ip(L) is supplied, a downstream grid voltage Vg(L) is applied to the downstream grid electrode 32*b* by the downstream grid voltage source S4. As a result, the downstream charger 32 forms, on the surface of the photosensitive member 1, a combined surface potential Vd(U+L) in the form of the upstream charge potential Vd(U) superposed with the downstream charge potential Vd(L).

Figure 6:
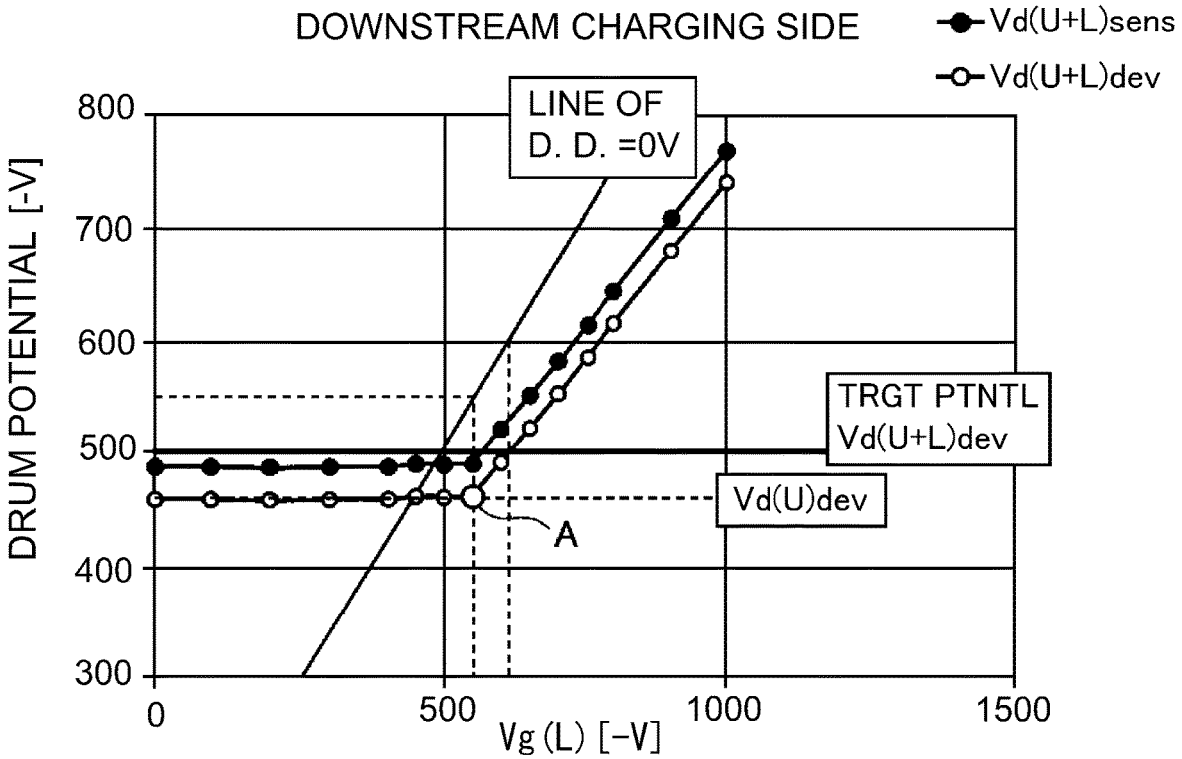
FIG. 6 is a graph showing a relationship between a charging voltage of a downstream charger and the charge potential of the photosensitive member.

FIG. 6 shows a relationship between the downstream grid voltage Vg(L) and the combined surface potential Vd(U+L) at the sensor position D and the developing position G in the case where the upstream charge potential Vd(U) is superposed with the downstream charge potential Vd(L). For example, in the case where the upstream charge potential Vd(U)dev at the developing position G is −460 V, when the downstream wire current Ip(L) is −1600 μA and the downstream grid voltage Vg(L) is −600 V, the combined surface potential Vd(U+L)dev at the developing position G is −500 V.

As shown in FIG. 6, in a range (0 V to −550 V) in which the downstream grid voltage Vg(L) is smaller in absolute value than −550 V, the combined surface potential Vd(U+L) is substantially constant at −460 V. On the other hand, when the downstream grid voltage Vg(L) is changed toward a value larger in absolute value than −550 V (for example, −550 V to −1000 V), the combined surface potential Vd(U+L) increases. This shows that when the downstream grid voltage Vg(L) is caused to fall in a range in which the downstream grid voltage Vg(L) is larger in absolute value than −550 V, the combined surface potential Vd(U+L) is formed by sensor of the downstream grid voltage Vg(L) on the upstream grid voltage Vg(U). That is, a symbol A shows the downstream grid voltage Vg(L) at which the charging process is started at a position of the downstream charger 32 with respect to the upstream charge potential Vd(U).

<2-3. Relationship Between Upstream Charge Potential and Downstream Charge Potential>

Next, a relationship between the upstream charge potential Vd(U) and the downstream charge potential Vd(L) will be described.

Figure 7:
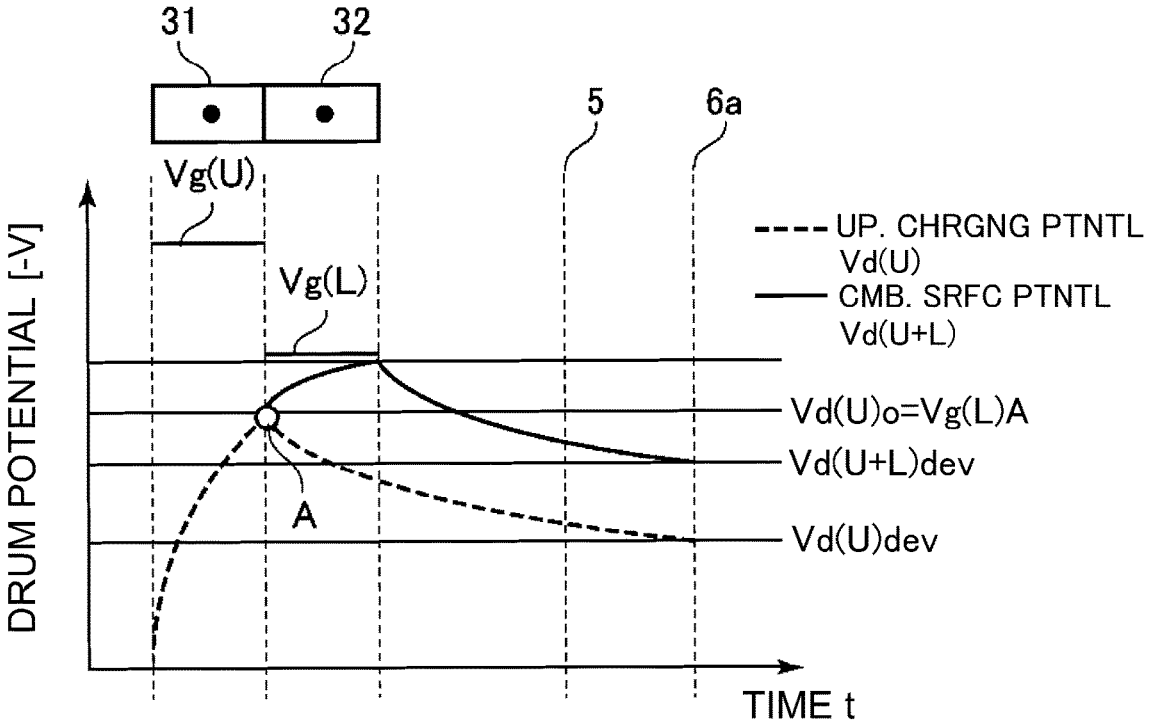
FIG. 7 is a graph showing a change in charge potential of the photosensitive member by each of the upstream and downstream chargers.

FIG. 7 is a schematic model view showing a change in surface potential of the photosensitive member 1 at a certain position from arrival at a position (discharging region) of the upstream charger 31 to the developing position G when the surface of the photosensitive member 1 is charged at the certain position by the upstream charger 31 and the downstream charger 32. In FIG. 7, a broken line represents the surface potential in the case where the photosensitive member surface is charged by the upstream charger 31 alone. In FIG. 7, a solid line represents the combined surface potential Vd(U+L) in the form of the upstream charge potential Vd(U) superposed with the downstream charge potential Vd(L) in the case where the photosensitive member surface is charged by the upstream charger 31 and the downstream charger 32.

As shown by the broken line in FIG. 7, in the case where the photosensitive member 1 is charged by the upstream charger 31 alone, the upstream charge potential Vd(U) starts a decay (attenuation) immediately after the certain position of the photosensitive member 1 passes through the upstream charger 31, and becomes the upstream charge potential Vd(U)dev at the developing position G. Further, as shown by the solid line in FIG. 7, the combined surface potential Vd(U+L) formed by the downstream charger 32 starts a decay (attenuation) immediately after the certain position of the photosensitive member 1 passes through the downstream charger 32, and becomes the downstream charge potential Vd(U+L)dev at the developing position G.

A potential when the upstream charge potential Vd(U) reaches a position (an opposing position to an upstream side end portion in the discharge region) immediately under the downstream charger 32 by rotation of the photosensitive member 1 is a "superimposed portion potential Vd(U)o". At this time, in the case where an absolute value of the downstream grid voltage Vg(L) is larger than an absolute value of the superimposed portion potential Vd(U)o, the charging process by the downstream charger 32 is carried out, so that the combined surface potential Vd(U+L) is formed. That is, when the downstream grid voltage Vg(L) (symbol A in FIG. 6) at which the charging process by the downstream charger 32 described with reference to FIG. 6 is started is a "superimposition start voltage Vg(L)A", the superimposition start voltage Vg(L)A is equal to the superimposed portion potential Vd(U)o.

Accordingly, the following can be said. In the case where the downstream grid voltage Vg(L) is changed, a relationship (approximate rectilinear line) between the downstream grid voltage Vg(L) and the surface potential in a region in which the surface potential is unchanged is acquired. Further, in the case where the downstream grid voltage Vg(L) is changed, a relationship (approximate rectilinear line) between the downstream grid voltage Vg(L) and the surface potential in a region in which the surface potential changes is acquired. Then, as shown in FIG. 6, the downstream grid voltage Vg(L) at a point of intersection of these relationships (approximate rectilinear lines) can be regarded as the superimposition start voltage (discharge start voltage) Vg(L)A.

Incidentally, as shown in FIG. 7, a potential difference between the superimposition start voltage Vg(L)A and the upstream charge potential Vd(U)dev at the developing position G can be regarded as a dark decay amount in a period from arrival of the upstream charge potential to the position immediately under the downstream charger 32 until the upstream charge potential reaches the developing position G.

Here, as described above, in a constitution in which the combined surface potential is formed by superimposing the charge potential formed by the second charger on the charge potential formed by the first charger, a relationship between the charge potentials formed by the respective chargers is important to make a finally formed charge potential of the photosensitive member uniform. Particularly, when the charge potential formed by the first charger exceeds a value of the voltage applied to the grid electrode of the second charger, it becomes difficult to control the charge potential of the photosensitive member by the second charger, so that "charging non-uniformity" increases. For that reason, it is desired that the voltage applied to the second charger is controlled by detecting the potential formed by the upstream charger when the upstream charge potential portion reaches the position immediately under the second charger in the image forming apparatus.

Therefore, in this embodiment, the superimposition start voltage Vg(L)A is detected on the basis of the relationship, measured in the image forming apparatus 100, between the downstream grid voltage Vg(L) and the surface potential as shown in FIG. 6. Then, the superimposition start voltage Vg(L)A is regarded as the superimposed portion potential Vd(V)o, and on the basis of a detection result of the superimposition start voltage Vg(L)A, setting of the downstream grid voltage Vg(L) is adjusted (changed).

In this embodiment, the downstream grid voltage Vg(L) is set in a range in which the downstream grid voltage Vg(L) is larger in absolute value than the superimposition start voltage Vg(L)A. By this, the upstream charge potential Vd(U) is prevented from exceeding the downstream grid voltage Vg(L) at the position immediately under the downstream charger 32, so that a desired charge potential can be obtained by controlling the combined surface potential by the downstream charger 32. Further, the downstream grid voltage Vg(L) is preferably set so that a potential difference between itself and the superimposition start voltage Vg(L)A falls within a predetermined range. By this, it becomes possible to more reliably form a substantially uniform charge potential decreased in charging non-uniformity.

<2-4. Relationship Between Charge Potential Applied to Downstream Charger and Charging Non-Uniformity>

Next, a relationship between the charging voltage applied to the downstream charger 32 and potential non-uniformity of the combined surface potential Vd(U+L) will be further described.

Figure 8:
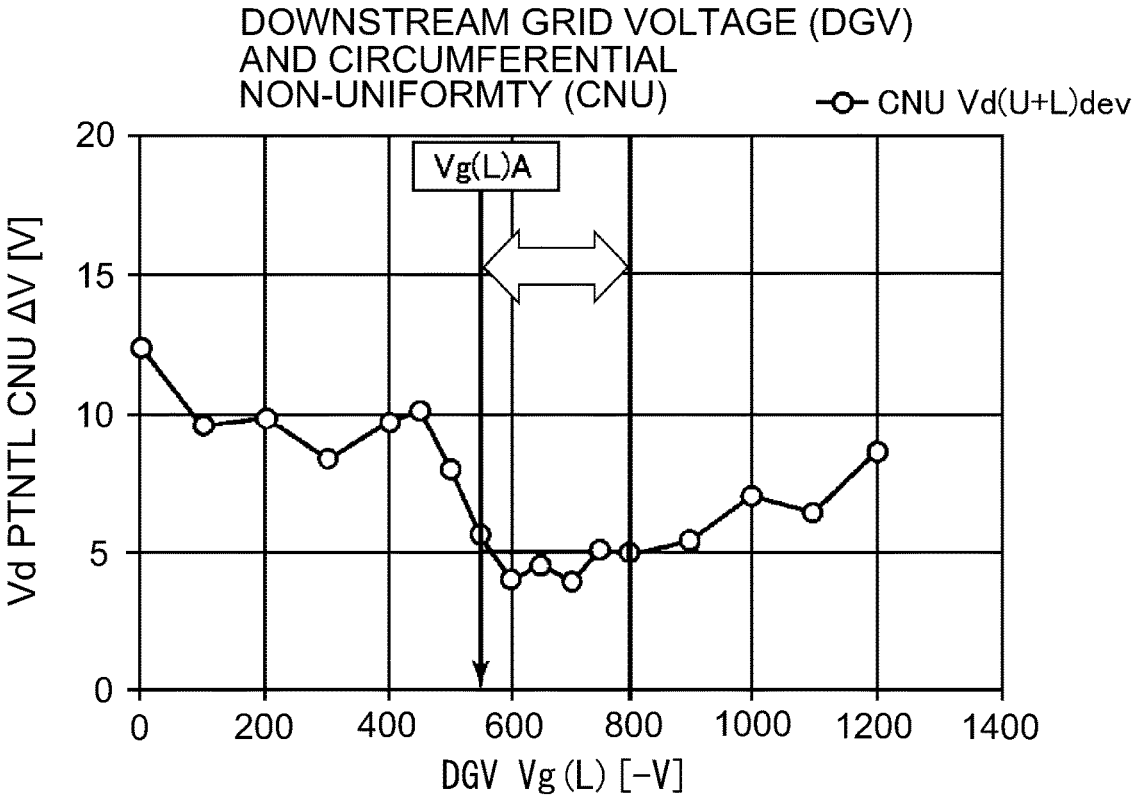
FIG. 8 is a graph showing a relationship between a downstream grid voltage and charge potential non-uniformity.

FIG. 8 is a graph showing a relationship between the downstream grid voltage Vg(L) and the potential non-uniformity (circumferential non-uniformity) of the photosensitive member 1 with respect to a circumferential direction of the photosensitive member 1. The figure shows the circumferential non-uniformity (a potential difference between a maximum and a minimum of the potential) of the combined surface potential Vd(U+L) at the developing position G in the case where the downstream grid voltage Vg(L) is changed in a state in which the upstream charge potential Vd(U) is controlled substantially uniformly at a target potential. Incidentally, the target potentials of the combined surface potential Vd(U+L)dev and the upstream charge potential Vd(U)dev at the developing position G are −500 V and −450 V, respectively, and each of the upstream wire current Ip(U) and the downstream wire current Ip(L) is −1600 μA. In this case, the superimposition start voltage Vg(L)A becomes −550 V.

As shown in FIG. 8, in a range (0 V to −550 V) in which the charging process by the downstream charger 32 is not performed and in which the downstream grid voltage Vg(L) is smaller in absolute value than −550 V, circumferential non-uniformity of about 10 V occurs. This would be considered because as described above, the upstream charge potential Vd(U) at the position immediately under the downstream charger 32 exceeds a value of the downstream grid voltage Vg(L) and thus control of the charge potential of the photosensitive member 1 by the downstream charger 32 becomes difficult.

On the other hand, in a range in which the downstream grid voltage Vg(L) is −550 V to −800 V, the circumferential non-uniformity decreases to about 5 V.

On the other hand, in a range (−800 V to −1200 V) in which the downstream grid voltage Vg(L) is larger in absolute value than −800 V (|superimposition start voltage Vg(L)A|+|−250 V|, the circumferential non-uniformity increases again. This would be considered that when a charge amount by the downstream charger 32 is made excessively large, a convergence property of the charge potential of the photosensitive member 1 with respect to the downstream grid voltage Vg(L) lowers.

Thus, by setting the downstream grid voltage Vg(L) in a range in which the downstream grid voltage Vg(L) is larger in absolute value than the superimposition start voltage Vg(L)A, which can be regarded as the superimposed portion potential Vd(U)o, an effect of decreasing the circumferential non-uniformity of the combined surface potential Vd(U+L) is obtained. However, in order to sufficiently obtain action of convergence of the charge potential of the photosensitive member 1 by the downstream charger 32, the downstream grid voltage Vg(L) may preferably be set in a range in which the downstream grid voltage Vg(L) is larger by 50 V or more in absolute value than the superimposition start voltage Vg(L)A, which can be regarded as the superimposed portion potential Vd(U)o. On the other hand, when the downstream grid voltage Vg(L) is made excessively large, the convergence property of the charge potential of the photosensitive member 1 by the downstream charger 32 lowers in some instances. For that reason, the downstream grid voltage Vg(L) may preferably be set in a range in which the downstream grid voltage Vg(L) is larger by 250 V or more in absolute value than the superimposition start voltage Vg(L)A which can be regarded as the superimposed portion potential Vd(U)o.

That is, the downstream grid voltage Vg(L) is set so as to satisfy the following formula:

$$|Vg(L)A| < |Vg(L)|.$$

Further, the downstream grid voltage Vg(L) may preferably be set so that the potential difference (|Vg(L)|−|Vg(L)A| between the downstream grid voltage Vg(L) and the superimposition start voltage Vg(L) A falls within a predetermined range. More specifically, the downstream grid voltage Vg(L) may preferably be set so as to satisfy the following formula (1):

$$50\ (\mathrm{V}) \leq |Vg(L)| - |Vg(L)A| \leq 250\ (\mathrm{V}) \quad (1).$$

Thus, in this embodiment, the absolute value of the downstream grid voltage Vg(L) is set in a range in which the absolute value is larger by 50 V to 250 V in absolute value than the absolute value of the superimposition start voltage Vg(L)A which can be regarded as the superimposed portion potential Vd(U)o. By this, the potential non-uniformity of the combined surface potential Vd(U+L)dev at the developing position G is decreased, so that the charge potential can be controlled substantially uniformly to −500 V which is the target potential.

<Adjusting Operation>

Next, an adjusting operation for adjusting setting of the charging voltage applied to the upstream charger 31 and the downstream charger 32 will be described.

Figure 9:
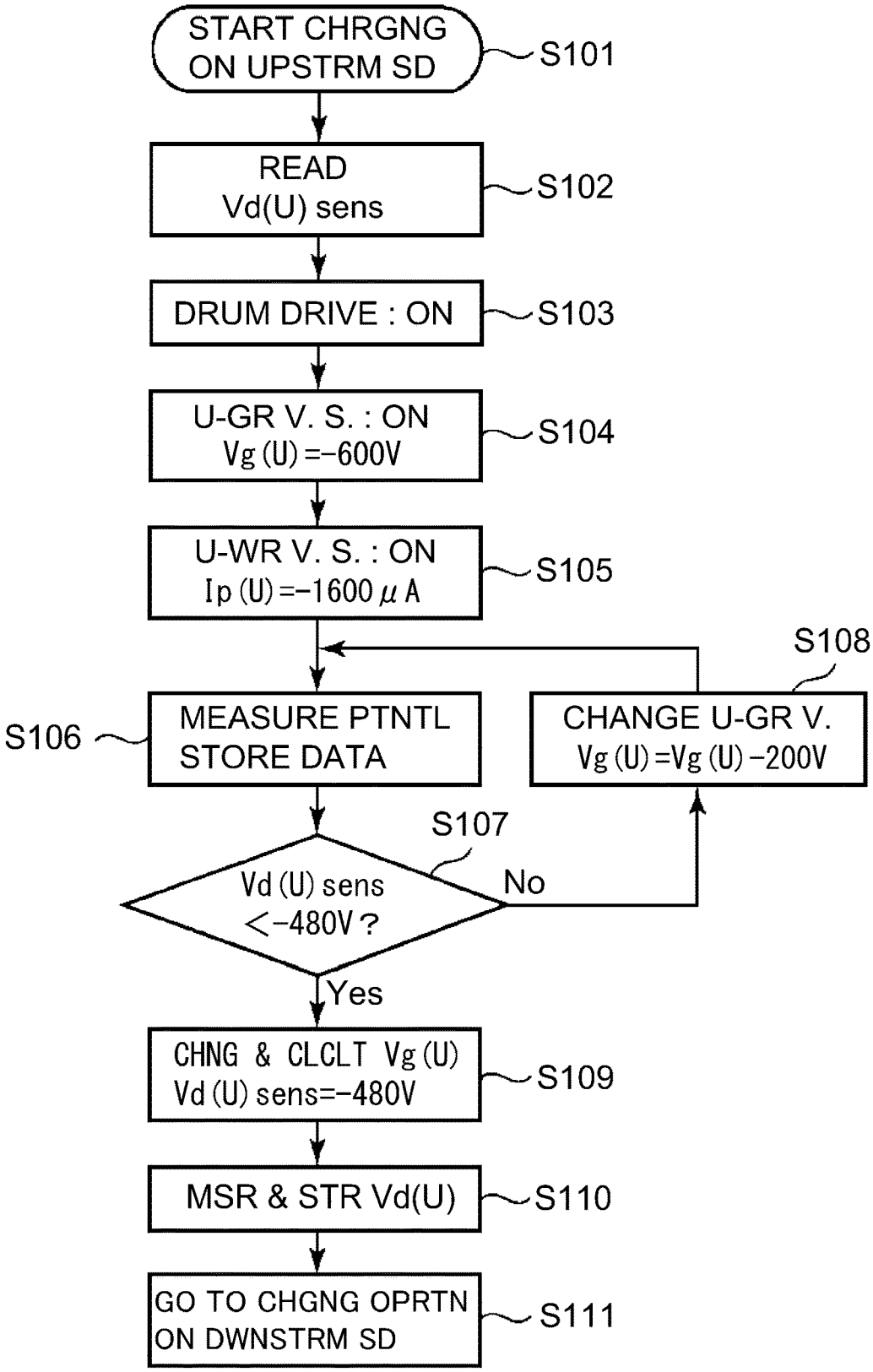
FIG. 9 is a flowchart showing a procedure of control of an upstream charge potential.
Figure 10:
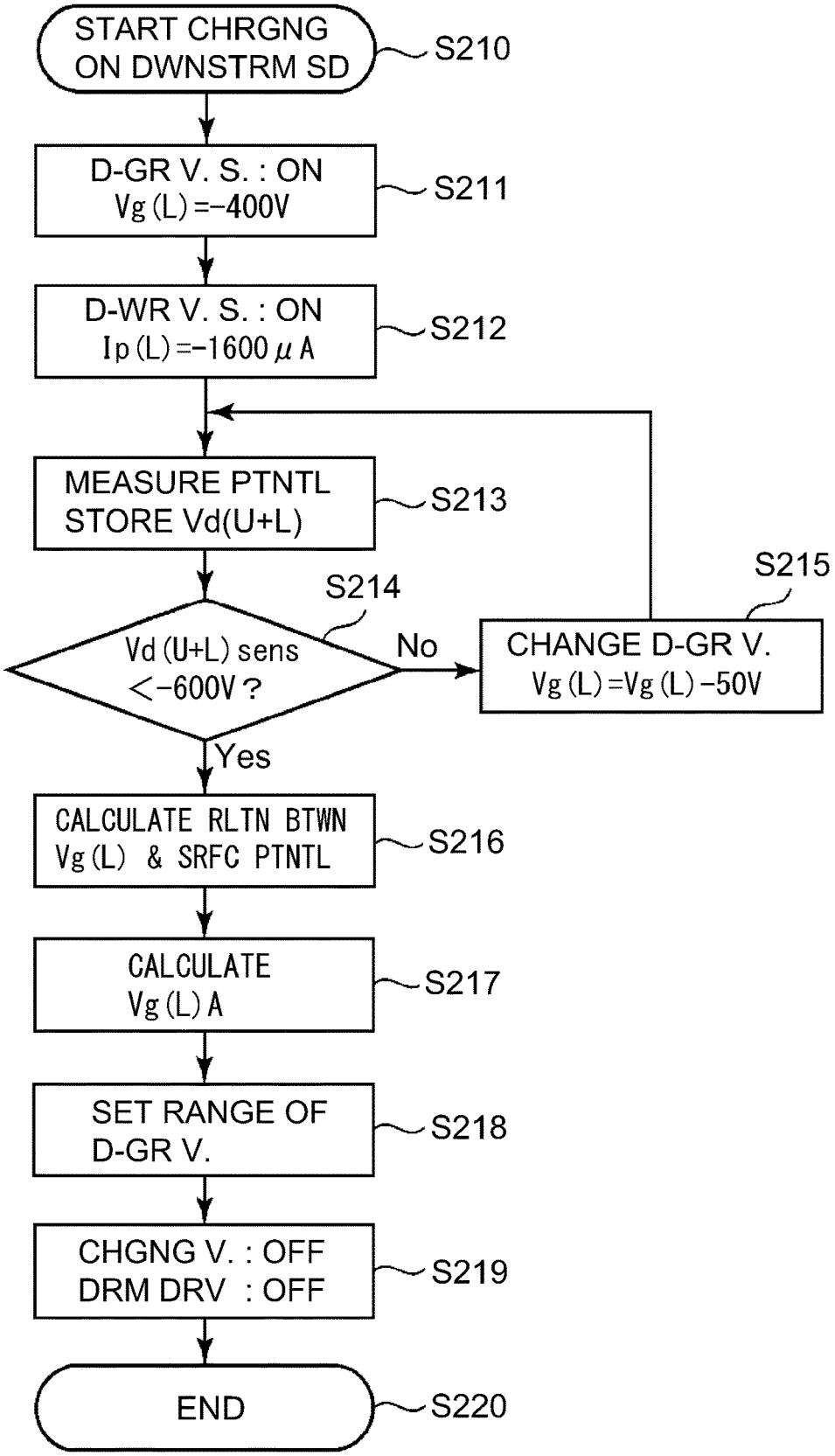
FIG. 10 is a flowchart showing a procedure for determining an adjustment start value of the downstream grid voltage.
Figure 11:
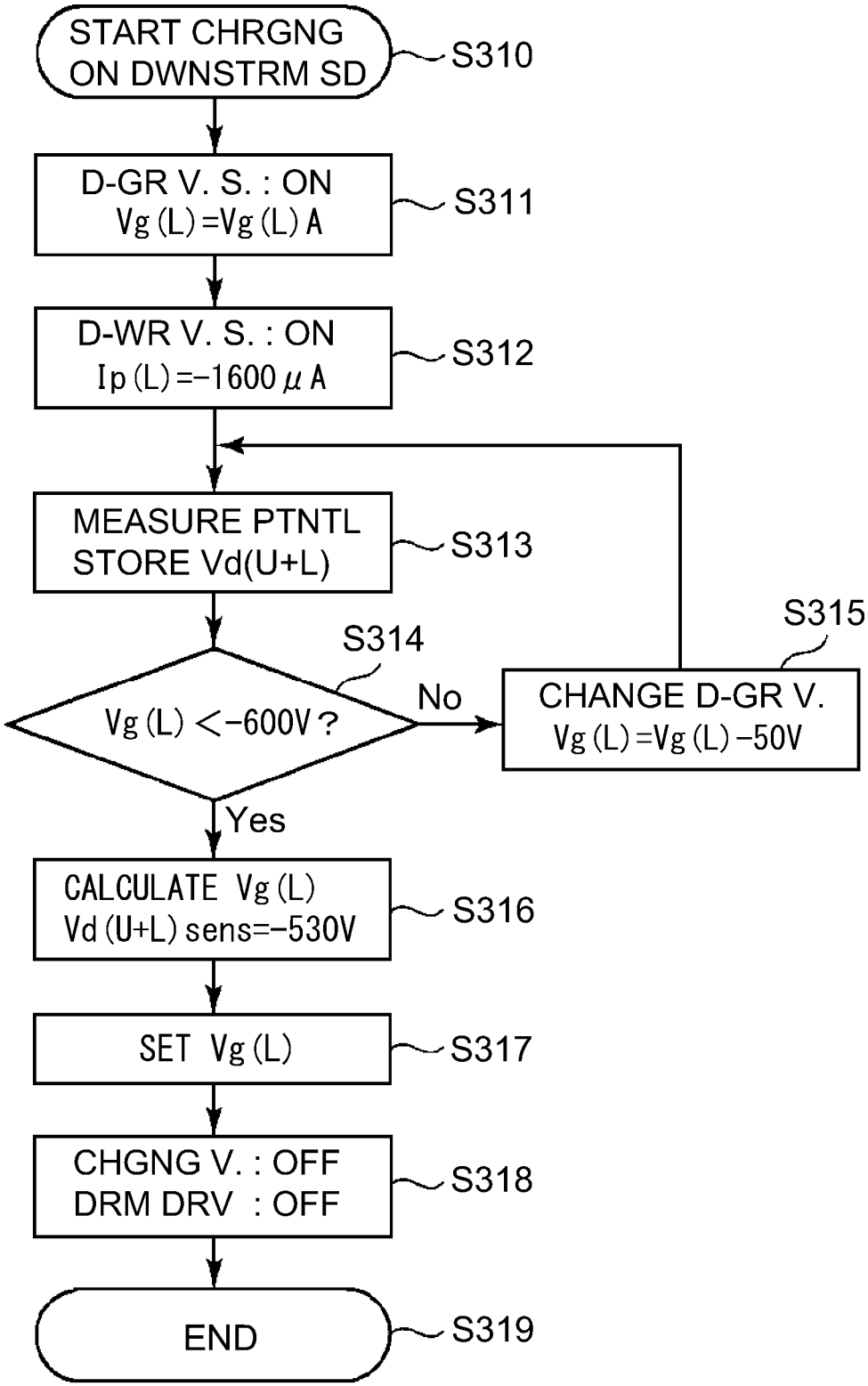
FIG. 11 is a flowchart showing a procedure of control of a combined surface potential.

FIG. 9 is a flowchart of a procedure of adjusting setting of the voltage applied to the upstream charger 31, and FIG. 10 is a flowchart of a procedure of determining an adjusting start value (and setting range) of the voltage applied to the downstream charger 31. FIG. 11 is a flowchart of a procedure of adjusting setting of the voltage applied to the downstream charger 31. By the procedures of FIGS. 9 to 11, the adjusting operation for adjusting the setting of the charging voltage is changed. Further, by the procedures of FIGS. 9 and 11, a potential controlling operation of the photosensitive member 1 is changed. The respective procedures of FIGS. 9 to 11 are controlled by the CPU 200.

Incidentally, the procedures of FIGS. 9 to 11 are carried out during non-image formation (non-image formation period) other than during image formation (image formation period) in which an image which is transferred and outputted on the recording material P. As during non-image formation, it is possible to cite during a pre-multi-rotation step and during a pre-rotation step which are during a preparatory operation before the image formation, during a sheet interval step corresponding to a period between an image and an image during continuous image formation, during a post-rotation step which is during a post-(preparatory) operation after the image formation, and during the like step. The adjusting operation constituted by the procedures of FIGS. 9 to 11 and the potential controlling operation of the photosensitive member 1 controlled by the procedures of FIGS. 9 and 11 are typically executed automatically by the CPU 200. Further, these operations can also be executed by the CPU 200 depending on an instruction of an operator from an operating portion (not shown) provided in the apparatus main assembly of the image forming apparatus 100.

<3-1. Adjusting Procedure of Setting of the Charging Voltage Applied to Upstream Charger>

First, with reference to FIG. 9, the procedure of adjusting the setting of the voltage applied to the upstream charger 31 will be described.

The CPU 200 causes the upstream charger 31 to start the charging operation of the photosensitive member 1 when timing of adjusting the setting of the voltage applied to the upstream charger 31 comes (S101). The CPU 200 reads an initial target value (−480 V in this embodiment) of the upstream charge potential Vd(U) at a sensor position D from the storing portion 600 (S102), and successively starts turning on of the light discharging device 40 and drive of the photosensitive member 1 (S103). After the photosensitive member 1 reaches steady rotation thereof, the CPU 200 causes the upstream grid voltage source S3 to apply the upstream grid voltage Vg(U) of −600 V as an initial value to the upstream grid electrode 31*b* (S104). Thereafter, the CPU 200 causes the upstream wire voltage source S1 to supply the upstream wire current value Ip(U) (=−1600 μA) to the upstream wire electrode 31*a*, so that the photosensitive member 1 is electrically charged (S105). Then, the CPU 200 causes the potential sensor 5 to measure the surface potential of the photosensitive member 1 and causes the storing portion 600 to store a measurement result (S106). Thereafter, the CPU 200 discriminates whether or not the upstream charge potential Vd(U)sens at the sensor position D is smaller (larger in absolute value) than the target value of −480 V (S107). In the case of "No" (Vd(U)sens≥−480 V) in a process of S107, the CPU 200 changes the upstream grid voltage Vg(U) to −200 V, i.e., in a direction of increasing the absolute value (S108), and repeats processes of S106 and S107. Further, in the process of S107, in the case of "Yes" (Vd(U)sens<−480 V), the CPU 200 adjusts (changes) the setting of the upstream grid voltage Vg(U) (S109).

That is, the CPU 200 acquires a relationship (FIG. 5) between the upstream grid voltage Vg(U) and the upstream charge potential Vd(U) on the basis of the measurement result by the processes of S106 to S108. The CPU 200 acquires, on the basis of the relationship, the upstream grid voltage Vg(U) at which the upstream charge potential Vd(U) sens at the sensor position D is the target value of −480 V, through calculation. Then, the CPU 200 adjusts (changes) the setting of the upstream grid voltage Vg(U) to a calculated value. Here, in the processes of S106 to S108, it is preferable that information on the relationship (FIG. 5) between the upstream grid voltage Vg(U) and the upstream charge potential Vd(U) in a range sandwiching the target value of the upstream charge potential Vd(U) can be acquired. Specifically, upstream grid voltages Vg(U) corresponding to at least one surface potential smaller in absolute value than the target value of the upstream charge potential Vd(U) and at least one surface potential larger in absolute value than the target value are made applicable. For that purpose, the absolute value of the initial value of the upstream grid voltage Vg(U) in S104 is made sufficiently small.

Thereafter, the CPU 200 causes the potential sensor 5 to measure the surface potential of the photosensitive member 1 and causes the storing portion 600 to store a measurement result (S110), and thereafter the operation goes to a charging operation of the photosensitive member 1 by the downstream charger 32 (S111).

Incidentally, in this embodiment, a target value of the upstream charge potential Vd(U)dev at the developing position G is set at a value smaller 1*a* 50 V in absolute value than a target value of the combined surface potential Vd(U+L) at the developing position G. This is because as described above, it is preferable that a charging process of at least about 50 V in absolute value is performed by the downstream charger 32 in order to sufficiently obtain the action of conveyance of the charge potential of the photosensitive member 1 by the downstream charger 32. In this embodiment, the target value of the combined surface potential Vd(U+L)dev at the developing position G is −500 V, and therefore, the target value of the upstream charge potential Vd(U)dev at the developing position G is set at −450 V. Further, in consideration of a dark decay amount of the charge potential of the photosensitive member 1 from the sensor position D to the developing position G, the target value of the upstream charge potential Vd(U)sens at the potential sensor position D is set at −480 V.

<3 2. Determination of Adjustment Start Value of Charging Voltage Applied to Downstream Charger>

Next, with reference to FIG. 10, a procedure of determining an adjustment start value (and a setting range) for adjusting the setting of the voltage applied to the downstream charger 32 will be described.

The CPU 200 causes the downstream charger 32 to start the charging operation of the photosensitive member 1 in a state in which the charging operation of the photosensitive member 1 by the upstream charger 31 is continued in the setting adjusted by the procedure of FIG. 9 (S210). The CPU 200 causes the downstream grid voltage source S4 to apply the downstream grid voltage Vg(L) of −400 V, which is a voltage in a range in which the charging process by the downstream charger 32 is not performed, as an initial value to the downstream grid electrode 32*b* (S211). Thereafter, the CPU 200 causes the downstream wire voltage source S2 to supply the downstream wire current value Ip(L) (=−1600 μA) to the downstream wire electrode 32*a*, so that the photosensitive member 1 is electrically charged (S212). Then, the CPU 200 causes the potential sensor 5 to measure the surface potential of the photosensitive member 1 and causes the storing portion 600 to store a measurement result (S213). Thereafter, the CPU 200 discriminates whether or not the downstream charge potential Vd(U+L)sens at the sensor position D is smaller (larger in absolute value) than −600 V (S214). Incidentally, the surface potential measured here is the upstream charge potential Vd(U) as it is in the case where the charging process by the downstream charger 32 is not performed, but herein is represented for convenience as being the "combined surface potential". In the case of "No" (Vd(U+L)sens≥−600 V) in a process of S214, the CPU 200 changes the downstream grid voltage Vg(L) to −50 V, i.e., in a direction of increasing the absolute value (S215), and repeats processes of S213 and S214. Further, in the process of S214, in the case of "Yes" (Vd(U+L)sens<−600 V), the CPU 200 acquires the superimposition start voltage Vg(L)A, which is an adjustment start value during setting of the downstream grid voltage Vg(L), and causes the storing portion 600 to store the superimposition start voltage Vg(L)A (S216, S217).

That is, on the basis of the measurement result in S213 to S215, the CPU 200 acquires a relationship (FIG. 6) between the downstream grid voltage Vg(L) in a region in which the surface potential is unchanged (constant at the upstream charge potential Vd(U)) in the case where the downstream grid voltage Vg(L) is changed and the surface potential. Here, this relationship is also referred to as a "relationship of unsuperimposed region". Further, the CPU 200 acquires a relationship (FIG. 6) between the downstream grid voltage Vg(L) in a region in which the surface potential is changed (increased in absolute value) in the case where the downstream grid voltage Vg(L) is changed and the surface potential. Here, this relationship is also referred to as a "relationship of superimposed region". Further, the CPU 200 acquires, as the superimposition start voltage Vg(L)A, the downstream grid voltage Vg(L) at a point of intersection of the relationship of unsuperimposed region and the relationship of superimposed region through calculation.

Incidentally, in the process of S213 and S215, it is preferable that information on the relationship of unsuperimposed region and the relationship of superimposed region can be acquired as in this embodiment. Specifically, surface potentials of the photosensitive member 1 for at least one downstream grid voltage Vg(L) in the region in which the surface potential is unchanged in the case where the downstream grid voltage Vg(L) is changed and for at least two downstream grid voltages Vg(L) in the region in which the surface potential is changed in the case where the downstream grid voltage Vg(L) is changed are made detectable. For that purpose, the absolute value of the initial value of the downstream grid voltage Vg(L) in S211 is made sufficiently small. Further, in the region in which the surface potential is unchanged in the case where the downstream grid voltage Vg(L) is changed, the surface potential is store constant at the upstream charge potential Vd(U). Accordingly, the relationship (slope) of superimposed region is acquired and the downstream grid voltage Vg(L) when it is the above-described constant surface potential (the upstream charge potential Vd(U)) in this relationship of superimposed region can also be acquired as the superimposition start voltage Vg(L)A. Further, depending on required adjusting accuracy, a value of the upstream charge potential Vd(U) can be stored in the storing portion 600 in S110 of FIG. 9 in place of acquisition of the relationship of unsuperimposed region.

Here, a state that the surface potential is "unchanged" in the case where the downstream grid voltage Vg(L) is changed is not limited to the case where the surface potential is completely constant. A ratio of the change is sufficiently smaller than a ratio of change in surface potential to a change in downstream grid voltage Vg(L) in the case where the charging process of the photosensitive member 1 is performed by electric discharge by the downstream charger 32, so that the change in a range showing that the charging downstream process is not performed. That is, in addition to a change to the extent of a measurement error occurring irrespective of the presence or absence of the charging process, also a change sufficiently distinguished clearly from the ratio in the case where the charging process is performed even in the change at a certain ratio is allowed. A degree of the allowed change can be acquired in advance by an experiment or the like depending on a structure of the image forming apparatus 100, a characteristic of the photosensitive member 1 and the like.

Thereafter, the CPU 200 determines a setting range (variable range) of the downstream grid voltage Vg(L) and causes the storing portion 600 to store the setting range (S218). This setting range of the downstream grid voltage Vg(L) is set to satisfy the relationship of the above-described formula (1) with respect to the superimposition start voltage Vg(L)A calculated in S217. Then, the CPU 200 stops application of the charging voltage and drive of the photosensitive member 1 (S219) and ends the procedure of determining the adjustment start value (and the setting range) for adjusting the setting of the voltage applied to the downstream charger 32 (S220).

Thus, by the procedure of FIG. 10, setting ranges of the superimposition start voltage Vg(L)A and further the downstream grid voltage Vg(L) are determined.

Incidentally, as described above, the reason why the initial value of the downstream grid voltage Vg(L) is set at −400 V in S211 is that the downstream grid voltage Vg(L) in the range in which the charging process by the downstream charger 32 does not start is applied. The voltage applied as this initial value can be arbitrary set in the range in which the charging process by the charger 32 is not started, depending on the structure of the image forming apparatus 100, a dark decay characteristic of the photosensitive member 1, and the like. Further, measurement of the surface potential may also be enabled using the initial value of a plurality of downstream grid voltages Vg(L).

Further, determination of the adjustment start value (and the setting range) for adjusting the setting of the downstream grid voltage Vg(L) by the procedure of FIG. 10 is not required to be executed every time when a potential control operation of the photosensitive member 1 is carried out. At least in the case where at least one of the upstream charger 31, the downstream charger 32 or the photosensitive member 1 is exchanged, the determination may desirably be executed before the image is first formed thereafter. Or, the determination may also be executed every excess of a predetermined threshold by for example a count value (the number of sheets subjected to image formation) by the sheet number counter 300, as information correlated with a use amount of at least one of the upstream charger 31, the downstream charger 32 or the photosensitive member 1. As the information correlated with this use amount, it is also possible to use a time of the charging process by at least one of the upstream charger 31 or the downstream charger 32, a rotation time (or the number of times of rotation) of the photosensitive member, and the like. Further, the determination may also be executed in the case where information on an environment detected by the environment sensor 500 changes by exceeding a range set in advance.

<3-3. Potential Control Operation of Photosensitive Member>

Next, the potential control operation of the photosensitive member 1 changed by procedures of FIGS. 9 and 11 will be described.

When timing of execution of the potential control operation of the photosensitive member 1 comes, first, the CPU 200 adjusts the setting of the upstream grid voltage Vg(U) by the procedure of FIG. 9. This procedure of adjusting the setting of the upstream grid voltage Vg(U) is as described with reference to FIG. 9, and therefore will be omitted from redundant description.

Next, the CPU 200 causes the downstream charger 32 to start the charging operation of the photosensitive member 1 in a state in which the charging operation of the photosensitive member 1 by the upstream charger 31 is continued in the setting adjusted by the procedure of FIG. 9 (S310). The CPU 200 causes the downstream grid voltage source S4 to apply, to the downstream grid electrode 32*b*, the superimposition start voltage Vg(L)A determined as the adjustment start value by the procedure of FIG. 10 (S311). Thereafter, the CPU 200 causes the downstream wire voltage source S2 to supply a downstream wire current Ip(L) (=−1600 μA) to the downstream wire electrode 32*a*, so that the photosensitive member 1 is electrically charged (S312). Next, the CPU 200 causes the potential sensor 5 to measure the surface potential of the photosensitive member 1 and causes the storing portion 600 to store a measurement result (S313). Thereafter, the CPU 200 discriminates whether or not the downstream grid voltage Vg(L) is smaller (larger in absolute value) than −600 V (S314). In the case of "No" (Vg(L)≥−600 V) in the process of S314, the CPU 200 changes the downstream grid voltage Vg(L) to −50 V, i.e., in a direction of decreasing the absolute value (S315), and repeats the processes of S313 and S314. Then, in the case of "Yes" (Vg(L)<−600 V) in the process of S314, the CPU 200 calculates the downstream grid voltage Vg(L), at which a target value of the combined surface potential VD(U+L)sens at the sensor position D is acquired (S316).

That is, on the basis of a measurement result by the processes of S313 to S315, the CPU 200 acquires the relationship between the downstream grid voltage Vg(L) and the combined surface potential Vd(U+L) (FIG. 6). The CPU 200 acquires, on the basis of the relationship, the downstream grid voltage Vg(L) at which the target value of the combined surface potential Vd(U+L)sens at the sensor position D is acquired, through calculation. Here, in the processes S313 to S315, it is preferable that information on a relationship between the downstream grid voltage Vg(L) and the combined surface potential Vd(U+L) in a range sandwiching the target value of the combined surface potential Vd(U+L) can be acquired. Specifically, downstream grid voltages Vg(L) corresponding to at least one surface potential smaller in absolute value than the target value of the combined surface potential Vd(U) and at least one surface potential larger in absolute value than the target value are made applicable. At this time, the superimposition start voltage Vg(L)A may preferably be contained as in this embodiment in the downstream grid voltage Vg(L) corresponding to at least one surface potential smaller in absolute value than the target value of the combined surface potential Vd(U+L). Further, the downstream grid voltage Vg(L) may preferably be changed within a setting range determined by the process of FIG. 10 and may also be changed to an upper limit of the setting range.

Incidentally, in the case where the downstream grid voltage Vg(L) at which the target value of the combined surface potential Vd(U+L) is acquired is not acquired in the case where the downstream grid voltage Vg(L) is changed within the setting range, the following cam be performed. That is, display (warning) for notifying a message to that effect at an operating portion (not shown) provided on the apparatus main assembly of the image forming apparatus 100 can be made or the adjusting operation can be performed again from the procedure of FIG. 9. Further, when the adjusting operation is performed again, the target value of the downstream charge potential Vd(U) may also be changed in a direction of increasing the absolute value, for example.

Thereafter, the CPU 200 adjusts (changes) the setting of the downstream grid voltage Vg(L) to a calculated value (S317). Then, the CPU 200 stops the application of the charging voltage and the drive of the photosensitive member 1 (S318) and ends the potential control operation (S219).

By performing the adjusting operation by the procedures of FIGS. 9 to 11, excess of the value of the downstream grid voltage Vg(L) immediately under the downstream charger 32 by the upstream charge potential Vd(U) is prevented, so that the charging voltage can be controlled to the charging condition in which the charging process by the downstream charger 32 is performed more reliably. Further, formation of the surface potential of the photosensitive member 1 sufficiently converging to the downstream grid voltage Vg(L) by the downstream charger 32 can be enabled, so that the charging voltage can be controlled to the charging condition in which a substantially uniform surface potential at which charging non-uniformity is reduced can be formed.

Embodiment 2

Another embodiment of the present invention will be described. A basic structure and a basic operation of an image forming apparatus in this embodiment are the same as those in Embodiment 1. Accordingly, in the image forming apparatus of this embodiment, elements having the same or corresponding functions or structures as those in Embodiment 1 are represented by the same reference numerals or symbols as those in Embodiment 1 and will be omitted from detailed description.

<1. Summary of this Embodiment>

In the first embodiment, after the upstream charge potential Wd(U) is determined, the superimposition start voltageA Vg(L)A, which is the downstream grid voltage Vg(L) at which the charging process by the downstream charger 31 is started, was detected using the potential sensor 5. On the other hand, in this embodiment, the superimposition start voltage Vg(L)A is detected using an ammeter for detecting a current flowing through the downstream grid electrode 32*b* (and the downstream shield electrode 32*c*). By this, the superimposition start voltage Vg(L)A can be detected with better accuracy than in the case of using the potential sensor 5.

<2. Structure of Charging Device>

Figure 12:
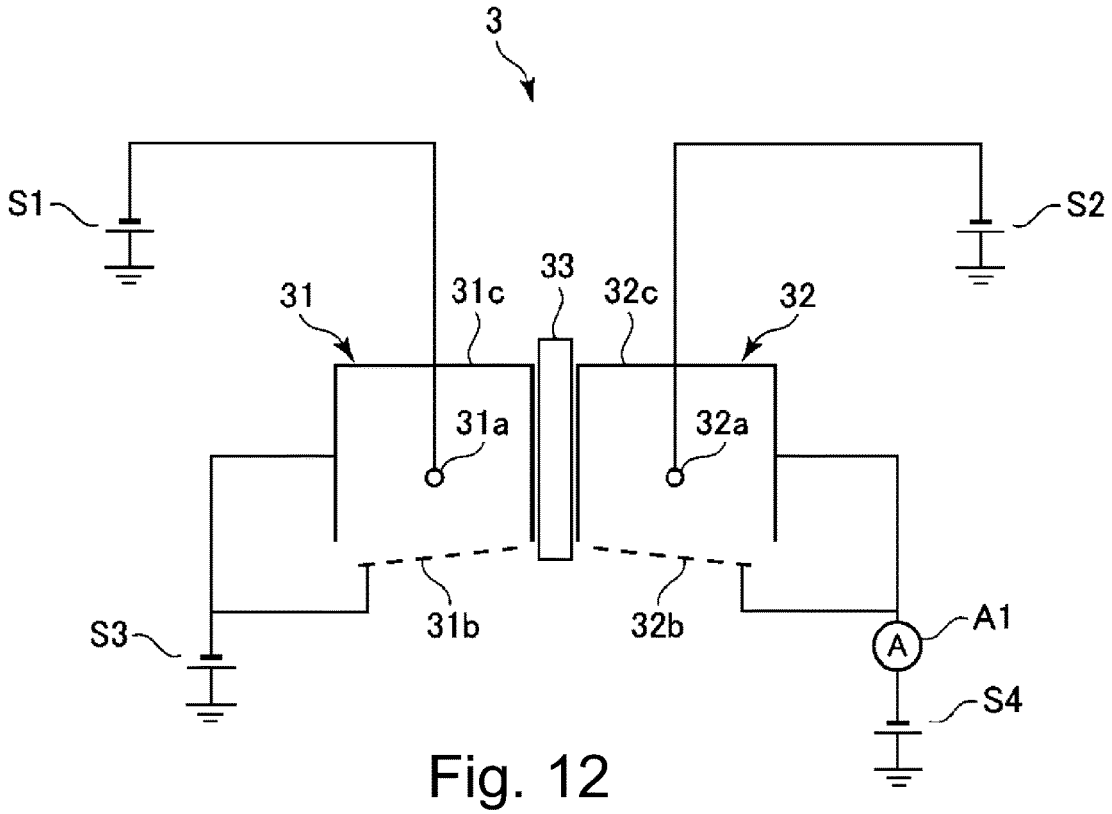
FIG. 12 is a schematic sectional view of another example of the charging device.

FIG. 12 is a schematic sectional view of a charging device 3 in this embodiment. In this embodiment, between the downstream grid electrode 32*b* and the downstream grid voltage source S4, an ammeter A1 as a current detecting means is connected. This ammeter A1 is also connected between the downstream shield electrode 32*c* and the downstream grid voltage source S4. By this, currents flowing through the downstream grid electrode 32*b* and the downstream shield electrode 32*c* when the downstream charger 32 performs the charging operation can be detected by the ammeter A1.

Further, this ammeter A1 is, as shown in FIG. 4, connected to the CPU 200 via the current detecting portion 900, which is a control circuit for controlling an operation of the ammeter A1. The CPU 200 reads a value of the current detected by the ammeter A1 (hereinafter this value is also referred to as a "current value A1"), and can cause the storing portion 600 to store the current value.

<3. Detection of Superimposition Start Voltage>

Figure 13:
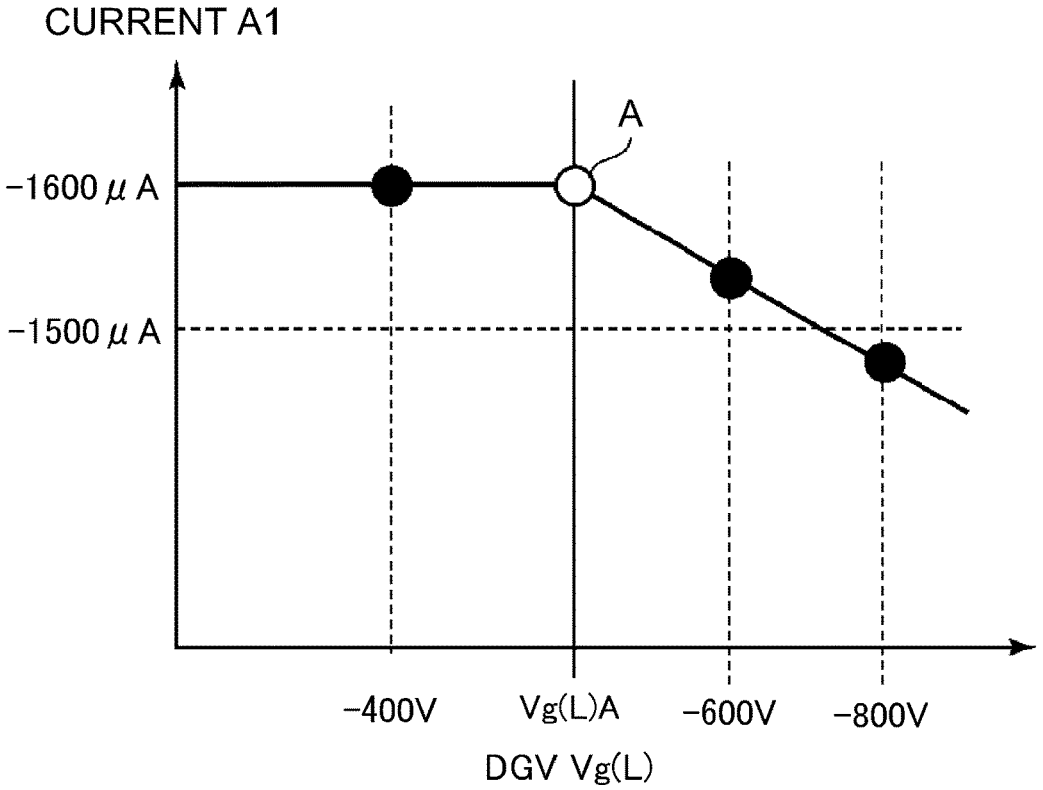
FIG. 13 is a graph showing a relationship between the downstream grid voltage and a current flowing through a downstream grid electrode.

A method of detecting the superimposition start voltage Vg(L) with the ammeter A1 will be described with reference to FIG. 13. FIG. 13 is a graph showing a value of a current measured by the ammeter A1 in the case where the downstream grid voltage Vg(L) is changed in a state in which the upstream charge potential Vd(U) (−480 V at the sensor position) is formed.

As shown in FIG. 13, in the case where the downstream grid voltage Vg(L) is −400 V, the charging process by the downstream charger 32 is not performed, and therefore, a current of −1600 μA which is equal to the downstream wire current supplied to the downstream wire electrode 32*a* is measured by the ammeter A1. Then, in the case where the downstream grid voltage Vg(L) is changed to −600 V and −800 V, the charging process by the downstream charger 32 is performed, and therefore, the absolute value of the current measured by the ammeter A1 lowers.

In this embodiment, the CPU 200 acquires the superimposition start voltage Vg(L)A by calculation on the basis of a relationship between the downstream grid voltage Vg(L) and the value of the current measured by the ammeter A1, as shown in FIG. 13. That is, the CPU 200 acquires a relationship ("relationship of unsuperimposed region") between the downstream grid voltage Vg(L) and the current value in a region in which the value of the current measured by the ammeter A1 becomes substantially constant (unchanged). Further, the CPU 200 acquires a relationship ("relationship of superimposed region") between the downstream grid voltage Vg(L) in a region in which the value of the current measured by the ammeter A1 with respect to the downstream grid voltage Vg(L) is changed and the current value. Further, the CPU 200 sets, as the superimposition start voltage Vg(L)A, the downstream grid voltage Vg(L) at a point of intersection of the relationship of unsuperimposed region and the relationship of superimposed region through calculation.

Here, a state that the value of the current is "changed" in the case where the downstream grid voltage Vg(L) is changed is not limited to the case where the current value is completely constant. A ratio of the change is sufficiently smaller than a ratio of change in current value to a change in downstream grid voltage Vg(L) in the case where the charging process of the photosensitive member 1 is performed by electric discharge by the downstream charger 32, so that the change in a range showing that the charging downstream process is not performed. That is, in addition to a change to the extent of a measurement error occurring irrespective of the presence or absence of the charging process, also a change sufficiently distinguished clearly from the ratio in the case where the charging process is performed even in the change at a certain ratio is allowed. A degree of the allowed change can be acquired in advance by an experiment or the like depending on a structure of the image forming apparatus 100, a characteristic of the photosensitive member 1, and the like.

<4. Determination of Adjustment Start Value of Voltage Setting of Downstream Charger>

Next, with reference to a flowchart of FIG. 14, a procedure of determining an adjustment start value (and a setting range) for adjusting the setting of the voltage applied to the downstream charger 32 will be described. Incidentally, in this embodiment, the procedures of FIGS. 9 and 11 are the same as those in Embodiment 1.

The CPU 200 causes the downstream charger 32 to start the charging operation of the photosensitive member 1 in a state in which the charging operation of the photosensitive member 1 by the upstream charger 31 is continued in the setting adjusted by the procedure of FIG. 9 (S410). The CPU 200 causes the downstream grid voltage source S4 to apply the downstream grid voltage Vg(L) of −400 V, which is a voltage in a range in which the charging process by the downstream charger 32 is not performed, as an initial value to the downstream grid electrode 32*b* (S411). Thereafter, the CPU 200 causes the downstream wire voltage source S2 to supply the downstream wire current value Ip(L) (=−1600 μA) to the downstream wire electrode 32*a*, so that the photosensitive member 1 is electrically charged (S412). Then, the CPU 200 causes the ammeter A1 to measure the value of the current flowing through the ammeter A1 and causes the storing portion 600 to store a measurement result (S413). Thereafter, the CPU 200 discriminates whether or not the value of the current measured by the ammeter A1 is larger (smaller in absolute value) than −1500 μA (S414). In the case of "No" (current value A1≤−1500 μA) in a process of S414, the CPU 200 changes the downstream grid voltage Vg(L) to −50 V, i.e., in a direction of increasing the absolute value (S415), and repeats processes of S413 and S414. Further, in the process of S414, in the case of "Yes" (current value A1>−1500 V), the CPU 200 acquires the superimposition start voltage Vg(L)A, which is an adjustment start value during setting of the downstream grid voltage Vg(L), and causes the storing portion 600 to store the superimposition start voltage Vg(L)A (S416, S417).

That is, on the basis of the measurement result in S413 to S415, the CPU 200 acquires a relationship between the relationship of unsuperimposed region and the relationship of superimposed region as described above (FIG. 13). Further, the CPU 200 acquires, as the superimposition start voltage Vg(L)A, the downstream grid voltage Vg(L) at a point of intersection of the relationship of unsuperimposed region and the relationship of superimposed region through calculation as described above.

Incidentally, in the process of S413 and S415, it is preferable that information on the relationship of unsuperimposed region and the relationship of superimposed region can be acquired. Specifically, current values for at least one downstream grid voltage Vg(L) in the region in which the current value is unchanged in the case where the downstream grid voltage Vg(L) is changed and for at least two downstream grid voltages Vg(L) in the region in which the current value is changed in the case where the downstream grid voltage Vg(L) is changed are made detectable. For that purpose, the absolute value of the initial value of the downstream grid voltage Vg(L) in S411 is made sufficiently small. Further, in the region in which the current value is unchanged in the case where the downstream grid voltage Vg(L) is changed, the current value is constant at the downstream wire current Up(L). Accordingly, the relationship (slope) of superimposed region is acquired and the downstream grid voltage Vg(L) when it is the above-described constant current value (the downstream wire current Ip(L) in this relationship of superimposed region can also be acquired as the superimposition start voltage Vg(L)A. Further, depending on required adjusting accuracy, a value of the downstream wire current Up(L) can be stored in place of acquisition of the relationship of unsuperimposed region.

Thereafter, the CPU 200 determines a setting range (variable range) of the downstream grid voltage Vg(L) and causes the storing portion 600 to store the setting range (S418). Similarly, as in Embodiment 1, this setting range of the downstream grid voltage Vg(L) is set to satisfy the relationship of the above-described formula (1) with respect to the superimposition start voltage Vg(L)A calculated in S417. Then, the CPU 200 stops application of the charging voltage and drive of the photosensitive member 1 (S419) and ends the procedure of determining the adjustment start value (and the setting range) for adjusting the setting of the voltage applied to the downstream charger 32 (S420).

Figure 14:
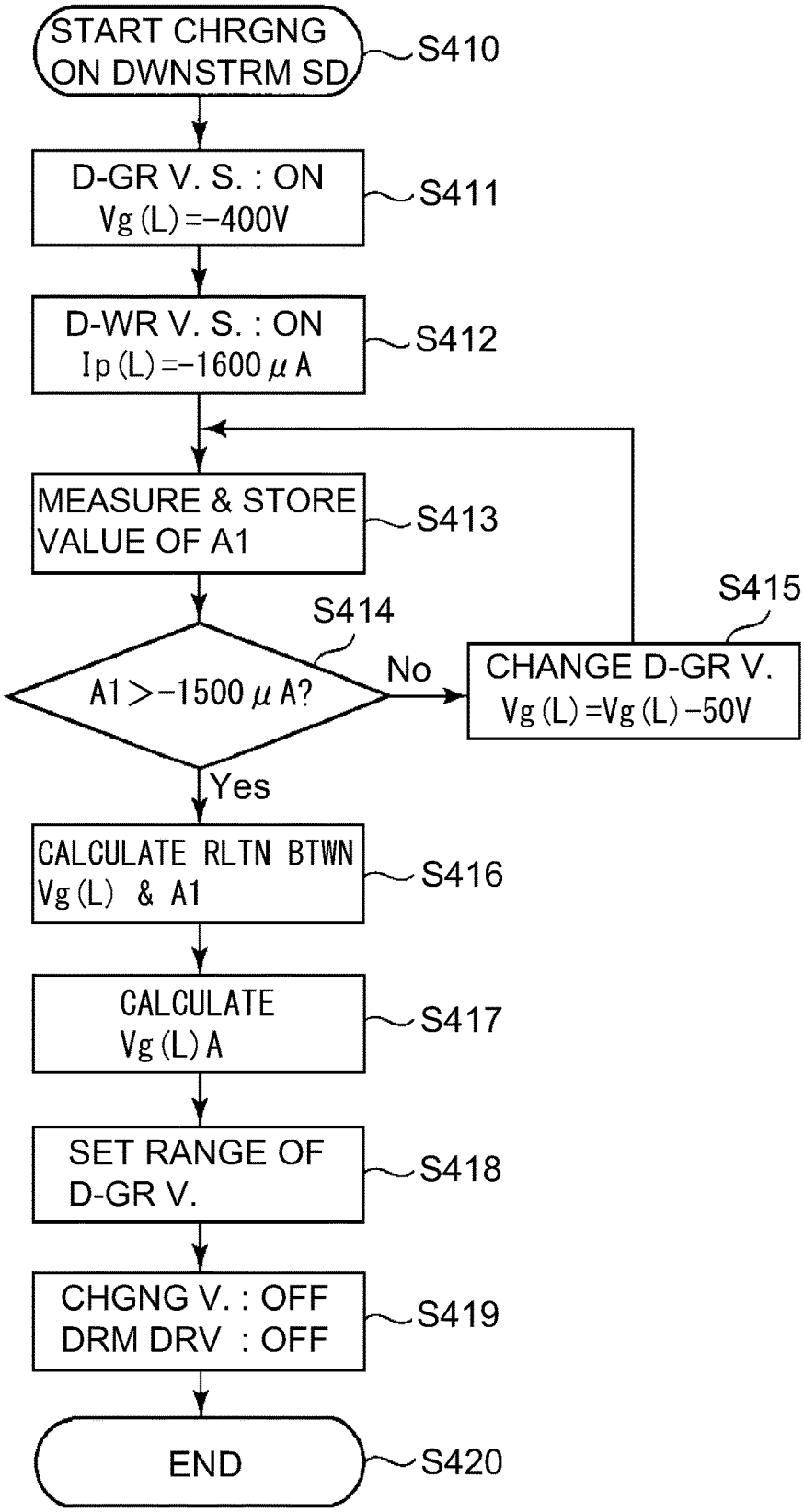
FIG. 14 is a flowchart showing another example of the procedure for determining the adjustment start value of the downstream grid voltage.

Thus, by the procedure of FIG. 14, setting ranges of the superimposition start voltage Vg(L)A and further the downstream grid voltage Vg(L) are determined.

Incidentally, as described above, the reason why the initial value of the downstream grid voltage Vg(L) is set at −400 V in S411 is that the downstream grid voltage Vg(L) in the range in which the charging process by the downstream charger 32 does not start is applied. The voltage applied as this initial value can be arbitrary set in the range in which the charging process by the charger 32 is not started, depending on the structure of the image forming apparatus 100, a dark decay characteristic of the photosensitive member 1, and the like. Further, measurement of the current value may also be enabled using the initial value of a plurality of downstream grid voltages Vg(L).

According to this embodiment, by detecting the superimposition start voltage Vg(L)A with the ammeter A1, detection accuracy of the superimposition start voltage Vg(L)A can be improved.

Embodiment 3

Another embodiment of the present invention will be described. A basic structure and a basic operation of an image forming apparatus in this embodiment are the same as those in Embodiment 1. Accordingly, in the image forming apparatus of this embodiment, elements having the same or corresponding functions or structures as those in Embodiment 1 are represented by the same reference numerals or symbols as those in Embodiment 1 and will be omitted from detailed description.

In this embodiment, on the basis of a principle described in Embodiment 1, in the apparatus in which the photosensitive member is electrically charged to a predetermined potential by the two chargers, setting of respective conditions of chargers such that non-uniformity of the surface potential of the photosensitive member is more efficiently reduced is enabled.

Figure 15:
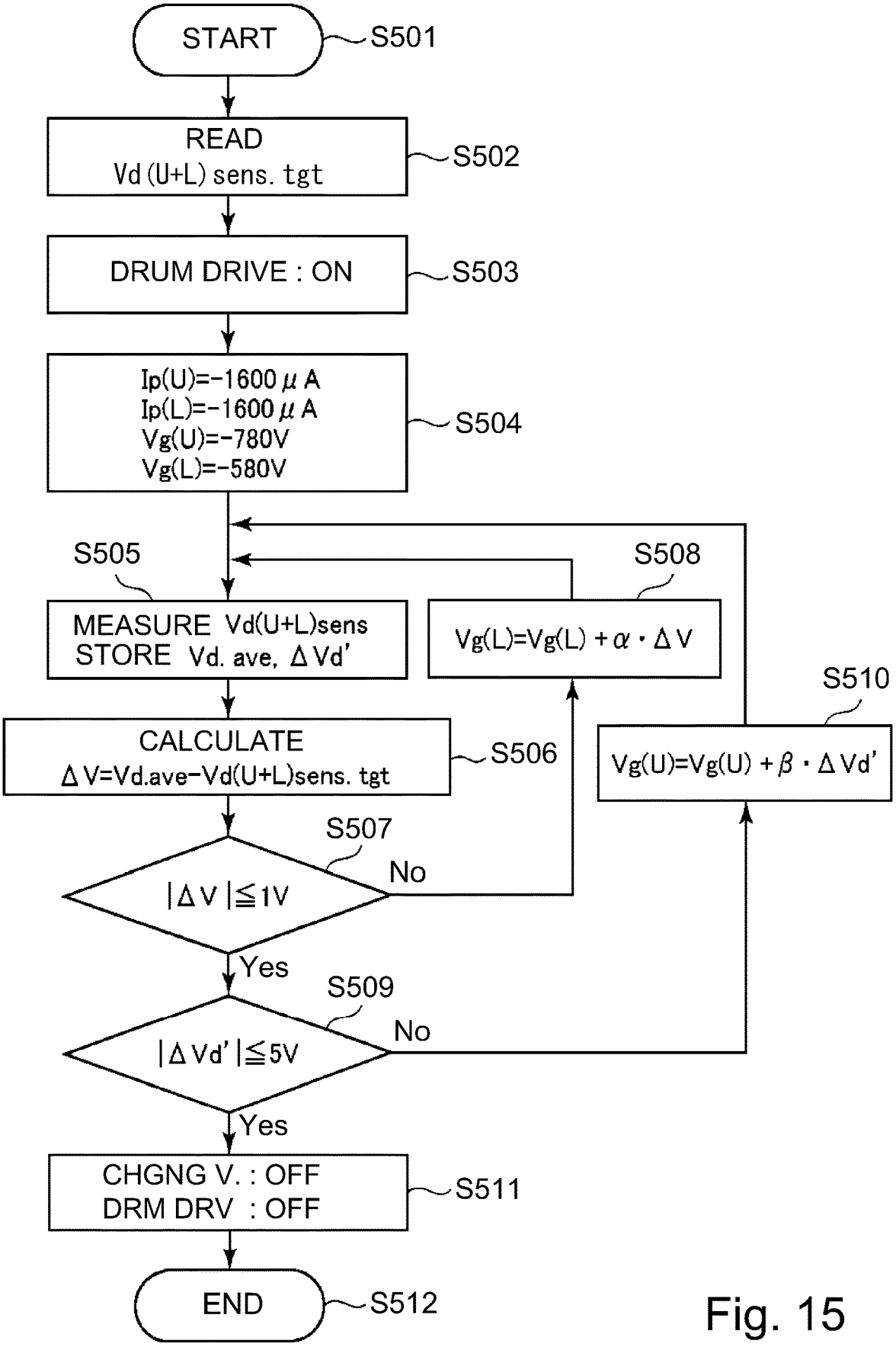
FIG. 15 is a flowchart showing another embodiment.

FIG. 15 is a flowchart of a procedure of an adjusting operation in this embodiment. Incidentally, the procedure of FIG. 15 is controlled by the CPU 200. Further, this procedure is carried out during non-image formation (non-image formation period) other than during image formation (image formation period). As described above, as during non-image formation, it is possible to cite during the pre-rotation step, during the sheet interval step, during a post-rotation step, and during the like step. The procedure of FIG. 15 is typically executed automatically by the CPU 200. Further, these operations can also be executed by the CPU 200 depending on an instruction of an operator from an operating portion (not shown) provided in the apparatus main assembly of the image forming apparatus 100.

When timing of adjusting the setting of the voltage applied to the upstream charger 31 comes (S501), the CPU 200 reads a target value Vd(U+L)sens.tgt (−480 V in this embodiment) of the charge potential Vd(U+L) at the sensor position D from the storing portion 600 (S502). Then, the CPU 200 causes the photosensitive member 1 to start drive thereof (S503). Then, after the photosensitive member 1 reaches steady rotation thereof, the CPU 200 causes the chargers to charge the photosensitive member 1 (S504). That is, the CPU 200 causes the upstream grid voltage source S3 to apply the upstream grid voltage Vg(U) of −780 V as an initial value to the upstream grid electrode 31*b* and causes the downstream grid voltage source S4 to apply the downstream grid voltage Vg(L) of −580 V as an initial value to the downstream grid electrode 32*b*. Then, the CPU 200 causes the upstream wire voltage source S1 to supply the upstream wire current Ip(U) (=−1600 μA) to the upstream wire electrode 31*a* and causes the downstream wire voltage source S2 to supply the downstream wire current Ip(L) (=−1600 μA) to the downstream wire electrode 32*a*.

Then, the CPU 200 causes the potential sensor 5 to measure the surface potential of the photosensitive member 1 and calculates the following Vd·ave and ΔVd' on the basis of a measurement result, and causes the storing portion 600 to store a measurement result (S505). That is, in S505, the CPU 200 sets timing of measurement so that the surface potential is measured at a plurality of points during one-full-turn of the photosensitive member 1. Then, the CPU 200 calculates each of an average Vd·ave of measurement results at the plurality of points and circumferential non-uniformity ΔVd' (=Vdmax−Vdmin) which is a difference between a maximum (Vdmax) and a minimum (Vdmin) in the measurement results at the plurality of points, and causes the storing portion 600 to store Vd·ave and ΔVd'.

Next, the CPU 200 calculates a difference ΔV (=Vd·ave−Vd(U+L)sens·tgt) between the average Vd·ave and the target value Vd(U+L)sens·tgt (S506).

Next, the CPU 200 discriminates whether or not an absolute value of ΔV is not more than 1 V (S507). In the case of "No" (|ΔV|>1 V) in the process of S507, the CPU 200 changes a current (present) downstream grid voltage Vg(L) to a value obtained by adding a value acquired by multiplying ΔV by a predetermined coefficient α (1.6 in this embodiment) and a current Vg(L) (S508). Thereafter, the CPU 200 repeats the processes of S505, S506 and S507. That is, the CPU 200 carries out feed-back control so that the average of the combined surface potential Vd(U+L) of the photosensitive member 1 converges to within a target potential range. Then, in the process of S507, in the case of "Yes" (|ΔV|<1 V), the CPU 200 causes the process to go to S509.

The CPU 200 discriminates whether or not an absolute value of circumferential non-uniformity ΔVd' calculated in S506 is not more than 5 V (S509). In the case of "No"

($|\Delta Vd'|>5$ V) in the process of S509, the CPU 200 changes a current (present) upstream grid voltage Vg(U) to a value obtained by adding a value acquired by multiplying $\Delta Vd'$ by a predetermined coefficient $\beta$ (25 in this embodiment) and a current Vg(L) (S510). Thereafter, the CPU 200 repeats the processes of S505, S506, S507, S508 and S509. That is, the CPU 200 carries out feed-back control so that the non-uniformity of the combined surface potential Vd(U+L) of the photosensitive member 1 with respect to a circumferential direction converges to within a predetermined range. Then, in the process of S509, in the case of "Yes" ($|\Delta Vd'|\leq 5$ V), the CPU 200 stops the application of the charging voltage and the drive of the photosensitive member 1 (S511), and ends the process (S512).

Thus, the image forming apparatus 100 includes the upstream grid voltage source (first voltage applying means) S3 for applying the upstream grid voltage (first voltage) to the upstream grid electrode 31*b*. Further, the image forming apparatus 100 includes the downstream grid voltage source (second voltage applying means) S4 for applying the downstream grid voltage (second voltage) to the downstream grid electrode 32*b*. Further, the image forming apparatus 100 includes the potential sensor (potential detecting means) 5 for detecting the combined surface potential Vd(U+L). Further, in this embodiment, the image forming apparatus 100 includes the CPU 200 as an executing portion for executing adjusting operations (S501 to S512) including a first adjusting operation and a second adjusting operation which are described as follows. In the first adjusting operation, the combined surface potential Vd(U+L) is controlled to the target potential range by adjusting the downstream grid voltage Vd(L) while electrically charging the photosensitive member 1 by the upstream charger 31 and the downstream charger 32 (S505 to S508). In the second adjusting operation, the non-uniformity of the combined surface potential Vd(U+L) with respect to the circumferential direction of the photosensitive member 1 is controlled to the predetermined range by adjusting the upstream grid voltage Vg(U) while electrically charging the photosensitive member 1 by the upstream charger 31 and the downstream charger 32 (S509 to S510).

That is, in this embodiment, in the first adjusting operation, the average of the combined surface potential Vd(U+L) is caused to converge to within the target range by adjusting the downstream grid voltage Vg(L). Further, in the second adjusting operation, the circumferential non-uniformity of the combined surface potential Vd(U+L) is caused to converge to the predetermined range by adjusting the upstream grid voltage Vd(U). By this, consequently, the upstream charge potential Vd(U) formed by the upstream grid voltage Vg(U) after the adjustment is suppressed from exceeding the downstream grid voltage Vg(L) after the adjustment. Further, in this embodiment, by simplification of the control, a desired combined surface potential Vd(U+L) reduced in non-uniformity of the surface potential of the photosensitive member can be obtained more efficiently.

As described above, according to the present invention, in the apparatus in which the photosensitive member is electrically charged to the predetermined potential by the two chargers, respective conditions of the chargers can be set such that the non-uniformity of the surface potential of the photosensitive member can be avoided.

Other Embodiments

In the above, the present invention was described based on specific embodiments, but is not limited to the above-described embodiments.

For example, as regards Embodiments 1 and 2, the target value of the first charge potential by the first charger is not limited to the values of the above-described embodiments. For example, the target value can be appropriately changed depending on the dark decay which is a charging characteristic of the photosensitive member and depending on a discharging characteristic of the charger. It may only be required that the second charger grid voltage which is the same potential as the potential when the first charge potential reaches the position immediately under the second charger can be detected.

Further, for example, as regards Embodiments 1 and 2, the image forming apparatus included the two chargers but may also include more chargers. In this case, setting of grid voltages may only be required to be successively adjusted similarly as in Embodiments 1 and 2 from a charger for performing the charging process of the photosensitive member early toward chargers for forming charge potentials by superimposing an associate charge potential on the charge potential which has already been formed. That is, setting of the grid voltage may only be required to be adjusted successively from a most upstream charger to a most downstream charger with respect to the movement direction of the surface of the photosensitive member. At this time, first, the most upstream charger and the charger adjacent thereto on the downstream side are used as the first and second chargers, respectively, and the setting of the grid voltage is adjusted in the order of the first charger and the second charger. Next, the two chargers which have been adjusted are regarded as the first charger, and the charger adjacent thereto on its downstream side is regarded as the second charger, and the setting of the grid voltage of the second charger is adjusted similarly as in Embodiments 1 and 2. Further, similarly, also in the case where there is a charger on a further downstream side, it may only be required that the three chargers which have been adjusted are regarded as the first charger, and the charger adjacent thereto on its downstream side is regarded as the second charger. By such control, as regards the charging process of the chargers except for the most upstream charger, the respective superimposition start voltages (corresponding to Vg(L)A in the above-described embodiments) are determined, and further, setting ranges (variable ranges) of the grid voltages can be set. In this case, the plurality of the setting ranges (variable ranges) may also be different from each other or the same as each other.

INDUSTRIAL APPLICABILITY

According to the present invention, an image forming apparatus in which a lowering in image quality due to charging non-uniformity is reduced is provided.

The invention claimed is:

1. An image forming apparatus comprising:

a rotatable photosensitive member;

first and second corona chargers configured to charge said photosensitive member; and a voltage applying portion configured to apply a first voltage Vg(U) and a second voltage Vg(L), which are independently variable, to grid electrodes of said first and second corona chargers, respectively, wherein said photosensitive member is charged by forming a combined surface potential Vd(U+L) by superimposing, on a first charge potential Vd(U) formed on a surface of said photosensitive member by said first corona charger, a second charge potential Vd(L) by said second corona charger, and wherein said image forming apparatus comprises a control portion configured to execute an adjusting operation in which a superimposition start voltage Vg(L)A, at which formation of the combined surface potential Vd(U+L) is started, is acquired by changing the second voltage Vg(L) in a state that the first charge potential Vd(U) is formed on the surface of said photosensitive member, and in which setting of the second voltage Vg(L) superimposed on the first charge potential Vd(U) during image formation is adjusted on the basis of the superimposition start voltage Vg(L)A.

2. An image forming apparatus according to claim 1, further comprising a potential detecting portion configured to detect a surface potential of said photosensitive member at a position of the combined surface potential, wherein said control portion acquires, in the adjusting operation, the superimposition start voltage Vg(L)A on the basis of a relationship between the second voltage Vg(L) acquired by changing the second voltage Vg(L) and the surface potential detected by said potential detecting portion.

3. An image forming apparatus according to claim 2, wherein in the adjusting operation, said control portion acquires, as the superimposition start voltage Vg(L)A, the second voltage Vg(L) at a point of intersection of a rectilinear line indicating a relationship between the second voltage Vg(L) in a region in which the surface potential detected by said potential detecting portion is unchanged in a case that the second voltage Vg(L) is changed and the surface potential detected by said potential detecting portion and a rectilinear line indicating a relationship between the second voltage Vg(L) in a region in which the surface potential detected by said potential detecting portion is changed in the case that the second voltage Vg(L) is changed and the surface potential detected by said potential detecting means portion.

4. An image forming apparatus according to claim 2, further comprising:

an exposure portion configured to expose the surface of said photosensitive member charged by said first and second corona chargers to form an electrostatic latent image; and a developing portion configured to develop the electrostatic latent image formed on the surface of said photosensitive member, wherein said potential detecting portion is arranged downstream of a position where said exposure portion exposes and upstream of said developing portion with respect to a rotational direction of said photosensitive member.

5. An image forming apparatus according to claim 1, further comprising a current detecting portion configured to detect a current flowing through the grid electrode of said second corona charger, wherein said control portion acquires, in the adjusting operation, the superimposition start voltage Vg(L)A on the basis of a relationship between the second voltage Vg(L) acquired by changing the second voltage Vg(L) and the current detected by said current detecting portion.

6. An image forming apparatus according to claim 5, wherein in the adjusting operation, said control portion acquires, as the superimposition start voltage Vg(L)A, the second voltage Vg(L) at a point of intersection of a rectilinear line indicating a relationship between the second voltage Vg(L) in a region in which the current detected by said current detecting portion is unchanged in a case that the second voltage Vg(L) is changed and the current detected by said current detecting portion and a rectilinear line indicating a relationship between the second voltage Vg(L) in a region in which the current potential detected by said current detecting portion is changed in the case that the second voltage Vg(L) is changed and the current potential detected by said current detecting portion.

7. An image forming apparatus according to claim 1, wherein said control portion sets the second voltage Vg(L) superimposed on the first charge potential Vd(U) during the image formation at a range in which the combined surface potential Vd(U+L) is changed in a case that the second voltage Vg(L) is changed.

8. An image forming apparatus according to claim 7, wherein said control portion sets the second voltage Vg(L) superimposed on a first charge potential Vd(U) so that a potential difference between the second voltage Vg(L) and the superimposition start voltage Vg(L)A falls within a predetermined range.

9. An image forming apparatus according to claim 8, wherein said control portion sets the second voltage Vg(L) during the charging process so as to satisfy the following formula:

$$50\ (\mathrm{V}) \leq |Vg(L)| - |Vg(L)A| \leq 250\ (\mathrm{V}).$$

10. An image forming apparatus according to claim 1, wherein said control portion sets the second voltage Vg(L) superimposed on the first charge potential Vd(U) during the image formation so as to satisfy the following formula:

$$|Vg(L)A| < |Vg(L)|.$$

11. An image forming apparatus according to claim 1, wherein said first and second corona chargers include a wire and a grid which generate discharge, respectively.

12. An image forming apparatus according to claim 11, wherein said first and second corona chargers include a shield which covers said wire, respectively.

13. An image forming apparatus according to claim 1, further comprising an insulating member arranged between said first corona charger and said second corona charger.

14. An image forming apparatus comprising:

a rotatable photosensitive member;

first and second corona chargers configured to charge said photosensitive member;

a voltage applying portion configured to apply a first voltage Vg(U) and a second voltage Vg(L), which are independently variable, to grid electrodes of said first and second corona chargers, respectively;

a potential detecting portion configured to detect a surface potential of said photosensitive member; and an executing portion configured to execute an adjusting operation, wherein said photosensitive member is charged by forming a combined surface potential Vd(U+L) by superimposing, on a first charge potential Vd(U) formed on a surface of said photosensitive member by said first corona charger, a second charge potential Vd(L) by said second corona charger, and wherein the adjusting operation comprises:

a first step configured to apply a plurality of the second voltages Vg(L) different in voltage value in a region at which the second voltage Vg(L) superimposed on the first charge potential Vd(U) is substantially unchanged to the first charge potential Vd(U);

a second step configured to apply a plurality of the second voltages Vg(L) different in voltage value in a region at which the second voltage Vg(L) superimposed on the first charge potential Vd(U) is changed to the first charge potential Vd(U); and a third step configured to determine the second voltage Vg(L) superimposed on the first charge potential Vd(U) during image formation on the basis of a relationship between the second voltage Vg(L) acquired by the first step and a potential detected by said potential detecting portion and a relationship between the second voltage Vg(L) acquired by the second step and a potential detected by said potential detecting portion.

15. An image forming apparatus according to claim 14, wherein the adjusting operation further comprises:

a fourth step configured to acquire as a superimposition start voltage Vg(L)A, the second voltage Vg(L) at a point of intersection of a rectilinear line indicating the relationship between the second voltage Vg(L) acquired by the first step and the potential detected by said potential detecting portion and a rectilinear line indicating the relationship between the second voltage Vg(L) acquired by the second step and the potential detected by said potential detecting portion, wherein the third step determines the second voltage Vg(L) superimposed on the first charge potential Vd(U) during the image formation on the basis of the superimposition start voltage Vg(L)A.

16. An image forming apparatus according to claim 14, wherein said first and second corona chargers include a wire and a grid which generate discharge, respectively.

17. An image forming apparatus according to claim 16, wherein said first and second corona chargers include a shield which covers said wire, respectively.

18. An image forming apparatus according to claim 14, further comprising:

an exposure portion configured to expose the surface of said photosensitive member charged by said first and second corona chargers to form an electrostatic latent image; and a developing portion configured to develop the electrostatic latent image formed on the surface of said photosensitive member, wherein said potential detecting portion is arranged downstream of a position where said exposure portion exposes and upstream of said developing portion with respect to a rotational direction of said photosensitive member.

* * * * *